US007896105B2

(12) United States Patent
Dupriest

(10) Patent No.: US 7,896,105 B2
(45) **Date of Patent: *Mar. 1, 2011**

(54) METHOD OF DRILLING AND PRODUCTION HYDROCARBONS FROM SUBSURFACE FORMATIONS

(75) Inventor: Fred E. Dupriest, Kingwood, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 381 days.

This patent is subject to a terminal disclaimer.

(21) Appl. No.: 11/991,514

(22) PCT Filed: Oct. 5, 2006

(86) PCT No.: PCT/US2006/039345

§ 371 (c)(1),
(2), (4) Date: Mar. 5, 2008

(87) PCT Pub. No.: WO2007/073430

PCT Pub. Date: Jun. 28, 2007

(65) Prior Publication Data

US 2009/0250264 A1 Oct. 8, 2009

Related U.S. Application Data

(60) Provisional application No. 60/738,146, filed on Nov. 18, 2005, provisional application No. 60/817,234, filed on Jun. 28, 2006.

(51) Int. Cl.
*E21B 47/00* (2006.01)
*E21B 49/00* (2006.01)

(52) U.S. Cl. ..... 175/40; 175/24; 175/50

(58) Field of Classification Search ..... 175/24, 175/40, 50

See application file for complete search history.

(56) References Cited

U.S. PATENT DOCUMENTS

| | | | |
|---|---|---|---|
| 4,507,735 | A | 3/1985 | Moorehead et al. |
| 4,736,297 | A | 4/1988 | LeJeune |
| 5,551,286 | A | 9/1996 | Booer |
| 5,730,234 | A | 3/1998 | Putot |
| 6,026,912 | A | 2/2000 | King et al. |
| 6,109,368 | A | 8/2000 | Goldman et al. |
| 6,155,357 | A | 12/2000 | King et al. |
| 6,192,998 | B1 | 2/2001 | Pinckard |

(Continued)

OTHER PUBLICATIONS

Anonymous, "MSE-based drilling optimization", Research Disclosure No. 459049, Research Disclosure Journal, Mason Publications, Hampshire UK, Jul. 2002, pp. 1-5.

(Continued)

*Primary Examiner* — Giovanna C Wright

(57) ABSTRACT

A method associated with the production of hydrocarbons. In one embodiment, a method for drilling a well is described. The method includes identifying a field having hydrocarbons. Then, one or more wells are drilled to a subsurface location in the field to provide fluid flow paths for hydrocarbons to a production facility. The drilling is performed by (i) estimating a drill rate for one of the wells; (ii) determining a difference between the estimated drill rate and an actual drill rate; (iii) obtaining mechanical specific energy (MSE) data and other measured data during the drilling of the one of the wells; (iv) using the obtained MSE data and other measured data to determine one of a plurality of limiters that limit the drill rate; (v) adjusting drilling operations to mitigate one of the plurality of limiters; (vi) and iteratively repeating steps (i)-(v) until the subsurface formation has been reached by the drilling operations.

58 Claims, 17 Drawing Sheets

U.S. PATENT DOCUMENTS

| | | | | |
|---|---|---|---|---|
| 6,293,356 | B1 | 9/2001 | King et al. | |
| 6,382,331 | B1 | 5/2002 | Pinckard | |
| 6,408,953 | B1 | 6/2002 | Goldman et al. | |
| 6,424,919 | B1 | 7/2002 | Moran et al. | |
| 6,443,242 | B1 | 9/2002 | Newman et al. | |
| 6,480,118 | B1 | 11/2002 | Rao | |
| 6,732,052 | B2 | 5/2004 | Macdonald et al. | |
| 6,820,702 | B2 | 11/2004 | Niedermayr et al. | |
| 6,892,812 | B2 | 5/2005 | Niedermayr et al. | |
| 6,968,909 | B2 | 11/2005 | Aldred et al. | |
| 7,020,597 | B2 | 3/2006 | Oliver et al. | |
| 7,031,840 | B1 | 4/2006 | Brett et al. | |
| 7,172,037 | B2 | 2/2007 | Dashevskiy et al. | |
| 7,261,167 | B2 | 8/2007 | Goldman et al. | |
| 2003/0015351 | A1 | 1/2003 | Goldman et al. | |
| 2005/0267719 | A1 | 12/2005 | Foucault | |
| 2006/0149478 | A1 | 7/2006 | Calhoun et al. | |
| 2006/0162962 | A1 * | 7/2006 | Koederitz et al. | 175/27 |

OTHER PUBLICATIONS

Anonymous, Concepts related to mechanical specific energy, Research Disclosure No. 492001, Research Disclosure Journal, Mason Publications, Hampshire UK, Mar. 3, 2005, pp. 1-14.

D. Curry, et al., "Technical Limit Specific Energy—An Index to Facilitate Drilling Performance Evaluation", SPE/IADC 92318, SPE/IADC Drilling Conference, Feb. 23-25, 2005, Amsterdam, The Netherlands, pp. 1-8.

F. E. Dupriest, "Comprehensive Drill-Rate Management Process to Maximize Rate of Penetration", SPE 102210, SPE Annual Technical Conference, Sep. 24-27, 2006, San Antonio, TX, pp. 1-9.

F. E. Dupriest, W. L. Koederitz, "Maximizing Drill Rates with Real-Time Surveillance of Mechanical Specific Energy", SPE/IADC 92194, SPE/IADC Drilling Conference, Feb. 23-25, 2005, Amsterdam, The Netherlands, pp. 1-10.

F. E. Dupriest, J. W. Witt, and S.M. Remmert, "Maximizing ROP with Real-Time Analysis of Digital Data and MSE", IPTC 10607, International Petroleum Technology Conference, Nov. 21-23, 2005, Doha, Qatar, pp. 1-8.

V. P. Perrin, et al., "Drilling Index—A New Approach to Bit Performance Evaluation", SPE/IADC 37595, Mar. 4-6, 1997, SPE/IADC Drilling Conference, Amsterdam, The Netherlands, pp. 199-205.

R. C. Pessier, M. J. Fear, Quantifying Common Drilling Problems With Mechanical Specific Energy and a Bit-Specific Coefficient of Sliding Friction, 67$^{th}$ SPE Annual Technical Conference, Oct. 4-7, 1992, Washington, DC, pp. 373-388.

S.M. Remmert, J.W. Witt and F. E. Dupriest, "Implementation of ROP Management Process in Qatar North Field", SPE/IADC 105521, Feb. 20-22, 2007, SPE/IADC Drilling Conference, Amsterdam, The Netherlands, pp. 1-10.

R. J. Waughman, et al., "Real-Time Specific Energy Monitoring Enhances the Understanding of When to Pull Worn PDC Bits", SPE Drilling & Completions, Mar. 2003, pp. 59-68.

European Search Report No. 113627 (for related application), dated May 18, 2006, 3 pages.

European Search Report No. 114732 (for related application), dated Mar. 20, 2007, 4 pages.

PCT International Search Report and Written Opinion (for related application), mailed Feb. 1, 2007, 6 pages.

PCT International Preliminary Report on Patentability (for related application), mailed Dec. 3, 2007, 4 pages.

* cited by examiner

METHOD OF DRILLING AND PRODUCTION HYDROCARBONS FROM SUBSURFACE FORMATIONS

CROSS REFERENCE TO RELATED APPLICATIONS

This application is the National Stage of International Application No. PCT/US06/39345, filed 5 Oct. 2006 which claims the benefit of U.S. Provisional Application No. 60/738,146, filed 18 Nov. 2005 and the benefit of U.S. Provisional Application No. 60/817,234, filed 28 Jun. 2006.

BACKGROUND

This section is intended to introduce the reader to various aspects of art, which may be associated with exemplary embodiments of the present techniques, which are described and/or claimed below. This discussion is believed to be helpful in providing the reader with information to facilitate a better understanding of particular aspects of the present techniques. Accordingly, it should be understood that these statements are to be read in this light, and not necessarily as admissions of prior art.

The production of hydrocarbons, such as oil and gas, has been performed for numerous years. To produce these hydrocarbons, one or more wells in a field are typically drilled to a subsurface location, which is generally referred to as a subterranean formation or basin. The process of producing hydrocarbons from the subsurface location typically involves various development phases from a concept selection phase to a production phase. One of the development phases involves the drilling operations that form the fluid paths from the subsurface location to the surface. The drilling operations may involve utilizing different equipment, such as hydraulic systems, drilling bits, motors, etc., which are utilized to drill to a target depth.

Generally, the drilling operations can be an expensive and time consuming process. For instance, the drilling costs for complex wells may be up to $500,000 a day with the drilling taking six months or more to reach a target depth. Accordingly, any reduction in drilling time represents a potential savings in the overall cost of a well. That is, the faster the drilling operations reach a specific target depth, the faster the wells may be utilized to produce hydrocarbons and the less expensive the cost of creating the well.

Typically, drilling rates have been evaluated by comparing performance to other wells previously drilled in the same field with each other. However, this approach is not able to confirm that the comparison well was drilled in an efficient manner. Indeed, both wells may be drilled in an inefficient manner, which is limited by the same founder or drilling problems. As a result, the drilling operations may be unnecessarily delayed and expensive.

Further, other techniques have involved using mechanical specific energy (MSE) data to optimize operation of parameters for a single well. See *MSE-based Drilling Optimization*, Research Disclosure 459049 (July 2002) <http://www.researchdisclosure.com>, which is herein referred to as "Research Disclosure 459049." With this approach, the MSE data is utilized to adjust operational parameters and indicate if subsequent wells are experiencing problems. However, the use of MSE data alone does not provide a clear insight into the factors limiting the drill rate.

Accordingly, the need exists for a method and apparatus to manage the drilling operations and enhance the drilling rate within a well based on MSE data and other measured data.

SUMMARY OF INVENTION

In one embodiment, a method for drilling a well is described. The method includes identifying a field having hydrocarbons. Then, at least one well is drilled to a subsurface location in the field to provide fluid flow paths for hydrocarbons to a production facility. The drilling is performed by (i) estimating a drill rate by analysis of historical mechanical specific energy data and related data from previous wells to determine one of a plurality of limiters that have previously limited the drill rate for one of the at least one well; (ii) determining an efficient drilling methodology through adjustment of designs and operating practices to address the limiters; (iii) obtaining mechanical specific energy (MSE) data and other measured data during the drilling of the one of the at least one well; (iv) using the obtained MSE data and other measured data to determine one of a plurality of limiters that limit the drill rate; (v) adjusting drilling operations to mitigate the one of the plurality of limiters; and iteratively repeating steps (i)-(v) until the subsurface location has been reached by the drilling operations. Then, hydrocarbons are produced from the at least one of the wells.

In a first alternative embodiment, a method for producing hydrocarbons is described. The method includes drilling a plurality of wells to at least one subsurface location to provide fluid flow paths for hydrocarbons to a production facility. The drilling comprises (i) estimating a drill rate for one of the plurality of wells; (ii) obtaining mechanical specific energy (MSE) data and other measured data during the drilling of the one of the wells; (iii) using the obtained MSE data and other measured data to determine one of a plurality of limiters that restrict the drill rate; (iv) adjusting drilling operations to mitigate the one of the plurality of founder limiters; and (v) iteratively repeating steps (i)-(v) until the subsurface location has been reached by the drilling operations. Then, hydrocarbons are produced from the one of the plurality of wells.

In a second alternative embodiment, another method for producing hydrocarbons is described. In this method, a drill rate is estimated for drilling operations of a well to provide fluid flow paths for hydrocarbons from a subsurface location to a production facility. Then, real time mechanical specific energy (MSE) data and other measured data are obtained during the drilling of the well. With the data, one of a plurality of limiters that restrict the drill rate is determined. Then, the drilling operations are adjusted to mitigate the one of the plurality of founder limiters. Each of these steps are repeated until the subsurface location has been reached by the drilling operations.

In a third alternative embodiment, a still another method for producing hydrocarbons is described. The method includes monitoring mechanical specific energy (MSE) data along with vibration data in real-time during drilling operations. The MSE data and the vibration data are compared with previously generated MSE data and vibration data to determine at least one of a plurality of factors that limit a drilling rate. Then, drilling operations are adjusted based on the comparison to increase the drilling rate.

In a fourth alternative embodiment, yet another method for producing hydrocarbons is described. The method comprises (a) obtaining mechanical specific energy (MSE) data along with other measured data for the well concurrently with the drilling of the well, analyzing the MSE data and other measured data to determine one of a plurality of limiters that restrict a drilling rate, and (c) adjusting drilling operations to account for the one of a plurality of limiters based on the analysis in step (b) to increase the drilling rate. The steps (a) to (c) are repeated at least one additional time until the target depth has been reached for the well. Then, hydrocarbons are produced from a subsurface reservoir accessed by the drilling operations.

In a fifth embodiment, a method for producing hydrocarbons is described. The method includes drilling a first well concurrently with a second well. Mechanical specific energy (MSE) data along with vibration data is monitored in real-time during drilling operations in the first well. The MSE data and the vibration data are compared to determine at least one of a plurality of factors that limit a drilling rate of the first well. Then, the drilling operations in the second well are adjusted based on the comparison to increase the drilling rate in the second well.

In a sixth embodiment, a method for producing hydrocarbons is described. The method includes analyzing historical mechanical specific energy (MSE) data and other historical measured data from a previous well to determine one of a plurality of initial factors that limit a drilling rate for the previous well; selecting drilling components and drilling practices to mitigate at least one of the plurality of the initial factors; drilling a current well utilizing the drilling components and drilling practices; observing the MSE data and other measured data during the drilling of the current well for at least one of a plurality of current factors that limit drilling operations; utilizing the observations in the selection of subsequent drilling components and subsequent drilling practices to mitigate at least one of the plurality of the current factors for a subsequent well; and repeating the steps above for each subsequent well in the program of similar wells.

BRIEF DESCRIPTION OF THE DRAWINGS

The foregoing and other advantages of the present technique may become apparent upon reading the following detailed description and upon reference to the drawings in which.

DETAILED DESCRIPTION

In the following detailed description, the specific embodiments of the present invention will be described in connection with its preferred embodiments. However, to the extent that the following description is specific to a particular embodiment or a particular use of the present techniques, this is intended to be illustrative only and merely provides a concise description of the exemplary embodiments. Accordingly, the invention is not limited to the specific embodiments described below, but rather, the invention includes all alternatives, modifications, and equivalents falling within the true scope of the appended claims.

The present technique is directed to a method of improving drilling rates based on mechanical specific energy (MSE) and other measured data. In particular, estimating a drill rate, then conducting real-time analysis of MSE and other measured data, such as vibration data, may be utilized to select drilling parameters, such as weight on bit (WOB), revolutions per minute (RPM) and hydraulic settings that provide efficient drill bit performance. Further, when drill bit performance is constrained by factors beyond the drilling parameters, the MSE data and other measured data provide documentation of founder limiters that may justify a redesign of the drilling components in the drilling system to design an efficient drilling methodology. In particular, the insights provided by MSE and vibration data provide an understanding of the issues limiting the drilling rate.

Based on the MSE and other measured data, a work flow, which may be herein referred to as the "Fast Drill Process" or "FDP," may be utilized to enhance the drilling operations utilized to produce hydrocarbons from subsurface reservoirs. The Fast Drill Process is a work flow or process that optimizes the rate of penetration (ROP) within a well based on technical and economical limitations. In this process, the drilling system may be redesigned to extend ROP limits and then iteratively repeated. Accordingly, the Fast Drill Process may be utilized to continuously increase the drilling rate for a well or concurrent wells by identifying founder limiters and providing solutions that remove and/or mitigate the impact of the founder limiters.

Figure 1:
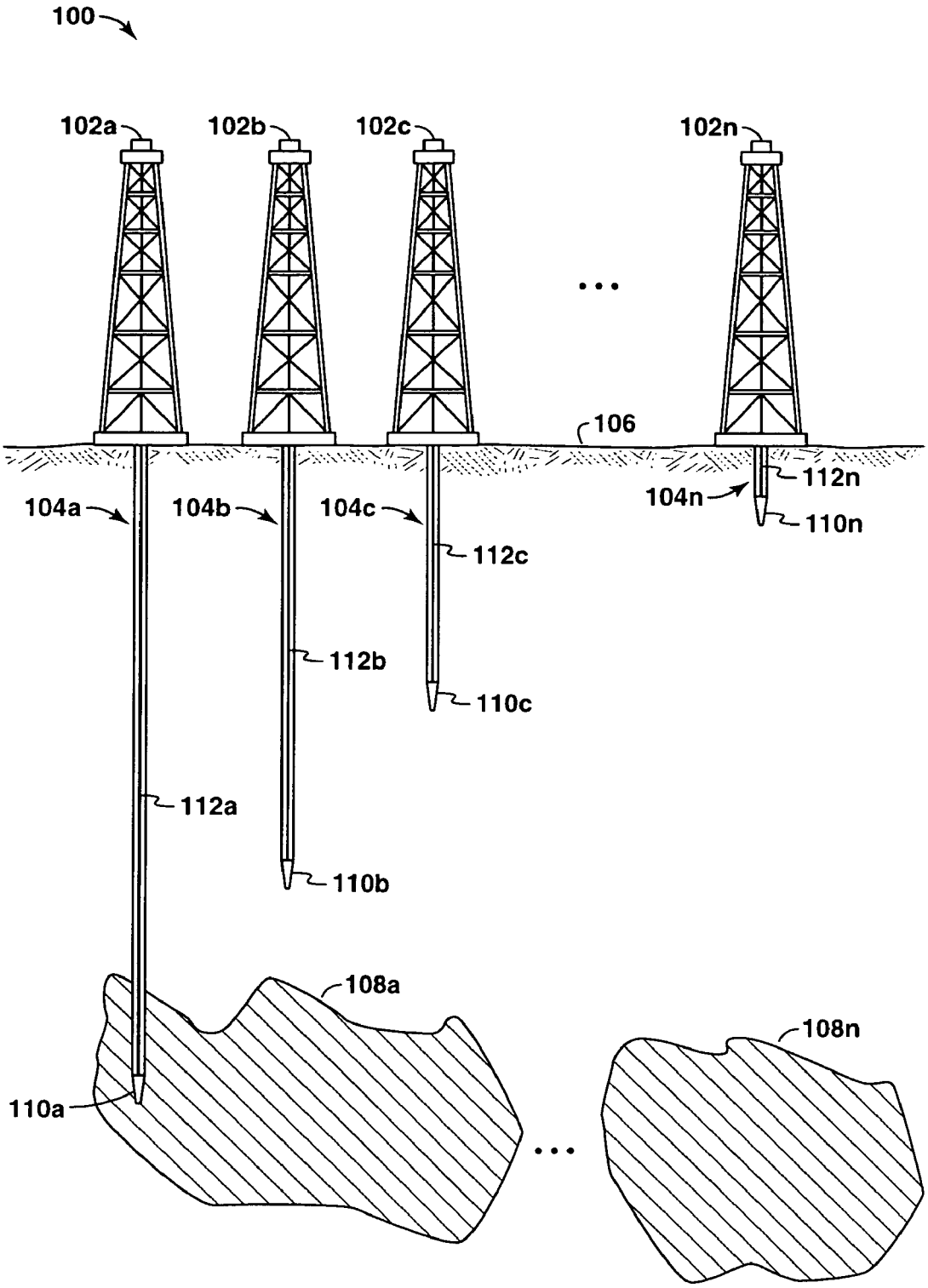
FIG. 1 is an exemplary production system in accordance with certain aspects of the present techniques.

Turning now to the drawings, and referring initially to FIG. 1, an exemplary production system 100 in accordance with certain aspects of the present techniques is illustrated. In the exemplary production system 100, one or more drilling systems 102*a*-102*n* are utilized to drill individual wells 104*a*-104*n*. The number n may be any number of drilling systems and wells that may be utilized based on a specific design for a field. These wells 104*a*-104*n* may penetrate the surface 106 of the earth to reach subsurface formations, such as subsurface formations 108*a*-108*n*, which includes hydrocarbons, such as oil and gas. Also, as may be appreciated, the subsurface formations 108*a*-108*n* may include various layers of rock that may or may not include hydrocarbons and may be referred to as zones or intervals. As such, the wells 104*a*-104*n* may provide fluid flow paths between the subsurface formations 108*a*-108*n* and production facilities located at the surface 106. The production facilities may process the hydrocarbons and transport the hydrocarbons to consumers. However, it should be noted that the drilling system 100 is illustrated for exemplary purposes and the present techniques may be useful in the production of fluids from any subsurface location.

To access the subsurface formations 108*a*-108*n*, the drilling systems 102*a*-102*n* may include drilling components, such as drill bits 110*a*-110*n*, drilling strings 112*a*-112*n*, bottom hole assemblies (BHAs), hoisting systems, power distribution systems, automatic controls, drilling fluids processing, pipe handling, downhole measurement tools, pumping systems and systems to manage borehole pressure. Each of these drilling components is utilized to form the wellbores of the various wells 104*b*-104*n*. The drill bits 110*a*-110*n* may be used to excavate formation, cement or other materials and may include various designs, such as roller cone, fixed cutter, natural diamond, polycrystalline diamond, diamond impregnated, underreamer, hole opener, coring bits, insert bits and percussion bits. In this example, the subsurface formation 108*a* is accessed by the well 104*a*, while wells 104*b*, 104*c* and 104*n* are in various stages of drilling operations to access the one or more of the subsurface formations 108*a* and 108*n*.

During the drilling operations, drilling systems 102*a*-102*n* may experience inefficiencies, which may influence drill rate performance. As the operator of the drilling systems 102*a*-102*n* may not control the factors affecting the drilling rate performance, drilling rates for two similar wells utilizing the same drilling components may vary. Typically, a drill rate test or drilloff tests, as known by those skilled in the art, is utilized to provide a rate of penetration (ROP) for a well. These tests involve adjusting the weight on bit (WOB) and revolutions per minute (RPM) to determine the ROP for a drilling system. See Fred E. Dupriest et al., *Maximizing Drill Rate with Real-Time Surveillance of Mechanical Specific Energy*, SPE/IADC 92194 (February 2005), which is herein referred to as "SPE Article 92194"; *Concepts Related to Mechanical Specific Energy*, Research Disclosure 492001 (April 2005)<http://www.researchdisclosure.com>, which is herein referred to as "Research Disclosure 492001"; and Fred E. Dupriest et al., *Maximizing ROP with Real Time Analysis of Digital Data and MSE*, IPTC 10706-PP (Nov. 22-23, 2005), which is herein referred to as "IPTC 10706-PP." Other approaches, which are similar to the drilloff tests, may involve the use of computers to observe and model trends in performance and attempt to identify a founder point, which is the point at which the ROP is maximized. Unfortunately, these tools and tests do not provide an objective assessment of the potential drill rate, only the founder point of the current drilling system.

For instance, the factors that determine ROP may be grouped into factors that create inefficiency, such as factors or founder limiters, and factors that limit energy input. Example factors that limit energy input include drill string make up, torque, hole cleaning efficiency, hole integrity to carry the cuttings load, mud motor differential pressure rating, mud motor bearing rating, directional target size, logging while drilling (LWD) rotational speed limits, available BHA weight, solids handling capacity, and top drive or rotary table torque rating. These factors limit the drilling system if the founder limiters do not occur as the WOB is increased. As such, these factors are the design limitations for a given drilling system.

While the factors that limit energy input may eventually constrain the drilling system, the founder limiters are factors that prevent the drilling system from reaching the performance normally expected for a drilling system that is not energy limited. The founder or flounder limiters may include bit balling, bottom hole balling, vibrations, which are discussed further in the Research Disclosure 492001, Research Disclosure 459049, and SPE Article 92194 (herein incorporated by reference), and non-bit related limiters, which are discussed below. As described in these articles, bit balling or bit structure cleaning is a condition in which the accumulation of material within the cutting structure interferes with the transfer of energy to the rock. That is, the build-up of debris in the cutting structure or the drill bit and associated components may limit a portion of the WOB applied to the cutting structure from reaching the rock. For instance, if rock cuttings are not cleared from the drilling bit, such as one of the drilling bits 110*a*-110*n*, the energy transfer to the rock declines below the expected value. The bit balling may be mitigated to some degree by adjusting various drilling components, such as changing out the nozzles and flow rates, to increase the hydraulics of the bit cleaning equipment.

Another founder limiter is bottom hole balling. Bottom hole balling is a condition in which the build up of material on the bottom of the wellbore interferes with the transfer of the energy from the drill bit to the rock beneath it. In particular, fine particles are held down by the differential pressure in a manner similar to filter cake. Bottom hole balling may be mitigated to some degree by adjusting operating parameters, such as bit rotational speed, utilizing bits that do not create bottom hole balling under the given conditions, or drilling with a light fluid so that hydrostatic head is less than pore pressure at the bottom of the wellbore.

Bit dulling is a condition where the drilling bit is inefficient because the tooth profile wears or changes due to effects of the drilling operation so that the transfer of energy to the rock becomes less efficient. Bit dulling differs from founder in that founder is the loss of efficiency that occurs only when a specific set of conditions develop, whereas bit dulling causes the efficiency to be lower under all conditions and during all drilling operations. Though the performance of a dull bit can be optimized by adjusting drilling parameters, the condition can only be mitigated completely by replacement of the bit.

In addition, various types of vibrations, such as lateral vibrations, torsional vibrations, and axial vibrations may be other founder limiters. For instance, whirling vibrations are a condition where the drilling system generates a whirling pattern that interferes with the transfer of energy to the rock. This whirling vibration is a result of the drilling bit not rotating around its center, which results in a loss of cutting efficiency. This type of vibration may be addressed by utilizing extended bit gauge lengths to improve lateral stability, utilizing stabilizers, high torque motors, and/or a low angle bent housing motor. Adjustments in WOB or RPM may also reduce whirl. Torsional or stick slip vibrations are a condition that occurs when the drill string oscillates about the axis of the string. The resulting periodic variation in the rotational speed of the drill bit causes the drilling process to become less efficient. This type of vibration may be mitigated by changing operating or drilling parameters, such as reducing WOB and/or increasing the rotary speed, for example. In addition, drilling components or equipment may be changed, such as increasing the outside diameter of the drillstring to increase the torsional stiffness, or utilizing a drill bit designed to create less torque. Finally, axial vibration is a condition during which periodic oscillations occur along the axis of the drill string so that the force applied to the drill bit varies. Uneven, periodic cycling of drilling force applied to the drill bit results in a reduction in drilling efficiency. This type of vibration may be mitigated by changing operating parameters, such as reducing WOB or RPM, or by utilizing equipment, such as shock absorbers. The various forms of vibrations may be coupled so that one creates another, which may also result in a process or tool used to mitigate a specific form of vibration also causing another form of vibration to decline.

In addition to bit related founder limiters discussed above, non-bit founder limiters or factors may also be present. These non-bit limiters, are particularly difficult to deal with systematically because of their great diversity and the breadth of expertise involved with addressing these limiters. Further, other non-bit limiters may include organizational processes, communication processes, rig workforce instability, contracting constraints, risk adverse behavior, and the lack of sharing between organizations. In particular, organizational processes may also be considered when mitigation of the problem involves increased mechanical risk, significant changes in established practices, or a high level of technical training.

Accordingly, even for these non-bit limiters, the above mentioned workflow is utilized to further enhance drilling operations.

To enhance the drilling rates of the drilling system 102*a*-102*n* by identifying and addressing these founder limiters, information and measured data may be accessed for each of the individual wells 104*a*-104*n* to enhance the drilling rates for that well. As discussed in Research Disclosure 492001, Research Disclose 459049, and SPE Article 92194, mechanical specific energy (MSE) is a mathematical calculation of the energy that is being used to drill a given volume of rock. See Research Disclosure 492001, Research Disclose 459049, and SPE Article 92194. This ratio of energy per rock volume is roughly equal to the compressive strength of the rock if the bit is perfectly efficient. The MSE for a well, such as wells 104*a*-104*n*, may be plotted in real-time as drilling progresses through the well 104*a*-104*n*.

In addition to the MSE data, other measured data may be used to evaluate the drilling efficiency of drilling bits, such as drilling bits 110*a*-110*n*. As such, the analysis of MSE data along with other measured data may be used to investigate specific inefficiencies in drilling operations. The MSE data and other measured data may be collected from wells 104*a*-104*n* to detect changes in the efficiency of the drilling system 102*a*-102*n* in a continuous manner. The data may be utilized to improve drilling performance by allowing the optimum operating parameters to be identified; and providing the quantitative data utilized to cost justify design changes in the drilling system to extend the current limits of the drilling system. The analysis of the MSE data along with the other measured data may result in redesigns in well control practices, drill bit selection, bottom hole assembly (BHA) design, makeup torque, directional target sizing and motor differential ratings. As such, the use of MSE data and other measured data may be utilized in a family of well planning and operational or drilling practices, which are collectively referred to as the "Fast Drill Process." The use of MSE and other measured data for increasing the ROP is further described in FIG. 2.

Figure 2:
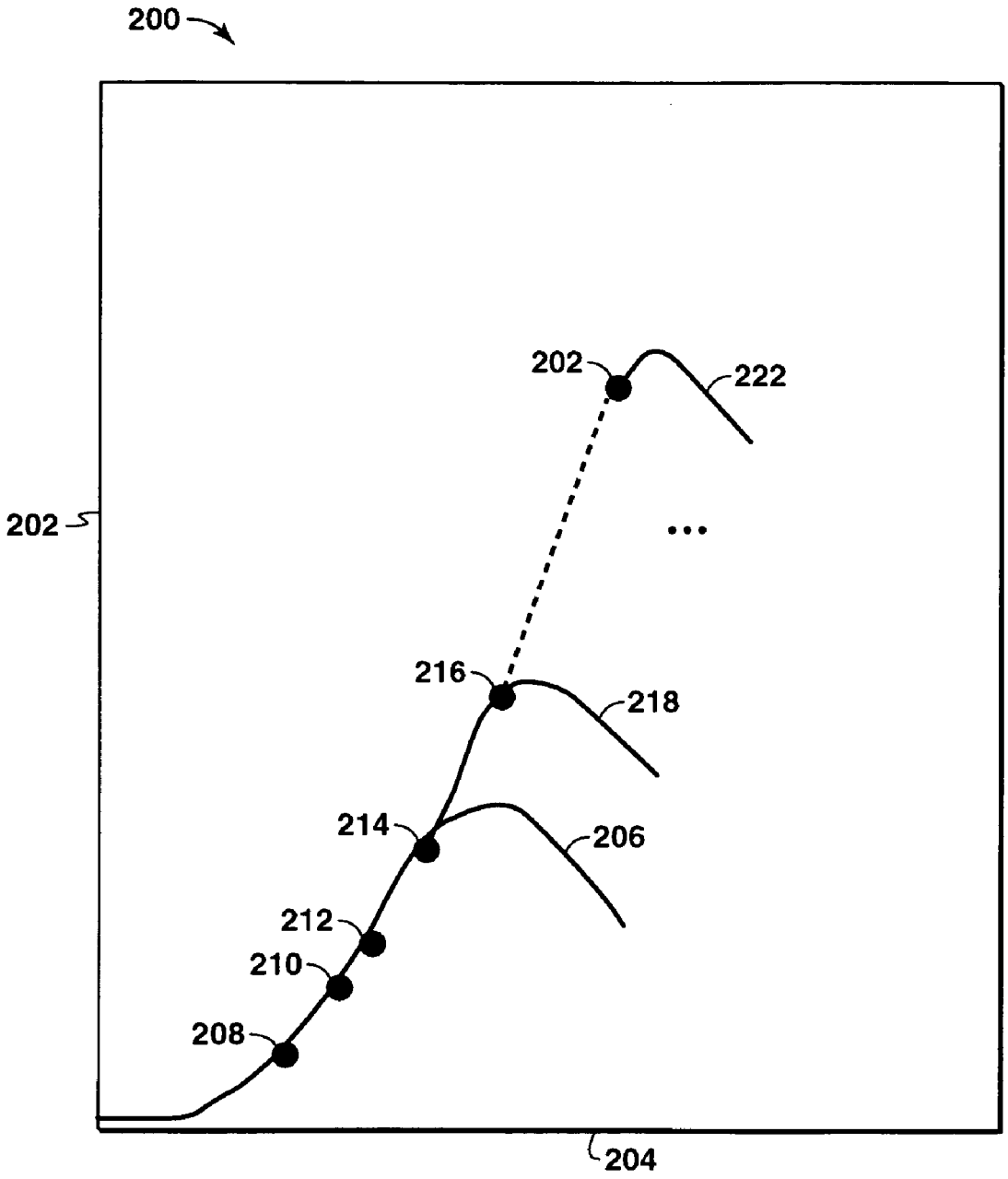
FIG. 2 is an exemplary chart of founder limiters for one of the wells in FIG. 1 in accordance with aspects of the present techniques.

FIG. 2 is an exemplary chart of founder limiters for one of the wells in FIG. 1 in accordance with aspects of the present techniques. In this chart, which is herein referenced by reference numeral 200, a curve 206, which may be referred to as a drilloff curve, indicates the notional relationship of the ROP 202 verses the WOB 204 for a specific design for a given well, such as one of the wells 104*a*-104*n*. Along this curve 206, different points relate to different operational or drilling settings. For instance, the first point 208 may be associated with motor differential rating, a second point 210 may be associated with directional targeting control, a third point 212 may be associated with hole cleaning, and a fourth point 214 may be a founder limiter, such as bit balling, bottom hole balling and vibrations. From this fourth point 214, an increase in WOB 204 may not significantly increase the ROP 202 because the ROP 202 or founder limit may not be resolved by any increases in WOB 204.

The curve 206 may be utilized to analyze the ROP for given WOBs. In a first region, which is defined by the WOB of zero up to the WOB at the first point 208, drill bits are known to be inefficient. There are various theories known in the art about the cause of this inefficiency. As the WOB and resulting depth of cut (DOC) increase, the drill bit eventually approaches its peak efficiency, which is calculated by comparing the theoretical energy required to remove a given volume of rock to the amount of energy used by the drill bit to remove the rock. In a second region, which is defined by the WOB from the first point 208 to the fourth point 214, the curve 206 increases in a substantially linear manner between the WOB 204 and ROP 202. This linear portion of the curve 206 indicates that the operation of the drill bit is as efficient as it is likely to become in the given conditions. Throughout this region, the ROP increases substantially linearly with increases in WOB, while the drill bit efficiency is unchanged. No environmental change may be made to the drilling system to cause the drill bit to increase the drilling rate. For instance, using a non-aqueous fluid does not increase the drilling rate more than a water-based mud with identical drill bits. Accordingly, only a change in the WOB or the RPM may increase the drill rate. The third segment, which is defined by the WOB from the fourth point 214 to the end of the remaining curve 206, is associated with a founder limiter that inhibits the transfer of energy from the drill bit to the rock. This founder point is close to the highest ROP that may be provided by the current drilling system. To increase the ROP beyond this founder limiter, the drilling system may be redesigned to modify components or utilize different components to extend the ROP limiter so that founder occurs at a higher WOB. As such, the slope of the drilloff curve may be utilized to indicate a founder limiter. A substantially non-linear response in ROP to an increase in WOB is an indication that the given WOB is above the founder point.

For instance, when operating in the second region of the curve 206 of FIG. 2, the bit is at peak efficiency and the ROP responses to increased WOB are approximately linear. In this region, increases in the ROP are directly related to increases in the WOB. Operations in this region are referred to as "non-bit limited" and the result is commonly called "control drilling." Example reasons for control drilling might include directional target control, hole cleaning, logging while drilling (LWD) data acquisition rates, shaker capacity, cutting handling or solids handling equipment limitations.

As an example, a drilloff test may produce the curve 206. Along the curve 206, when the ROP 202 stops responding linearly with increasing WOB 204, a founder limiter exists that limits the ROP or drilling rate. As such, this WOB 204 is taken to be the optimum drilling rate with the current drilling system. Because only changes in the drilling system components and practices may increase the ROP 202, the analysis of MSE trends along with other measured data, such as vibration data, may be utilized to identify the founder limiter and increase the drilling rate by removing the founder limiter. Relating the real-time MSE data and other measured data may be beneficial in determining the founder limiter and extending the ROP to the next founder limiter.

Once the founder limiter associated with the fourth point 214 is remedied, the ROP 202 may be extended to the next founder limiter, which is indicated by a fifth point 216. That is, the drilling components may be changed to increase the ROP to another founder limiter that results in an extended curve 218. Using this process, an operator may address one limiter at a time to further enhance drilling operations. Along the curve 218, different operational or drilling parameters may be adjusted to further extend the ROP above the founder limit of the curve 206. Further, additional extended curves, such as curve 222, may be created by other drilling component changes that address the other founder limiters. For instance, the sixth point 220 may be associated with increasing bit durability, available BHA weight, drill string make-up torque, or rig top drive or rotary torque. These drilling component redesigns may be utilized to extend the founder limiters that reduce efficiency and limit the ROP. The drilling process that utilizes this process is discussed further below in FIG. 3.

Figure 3:
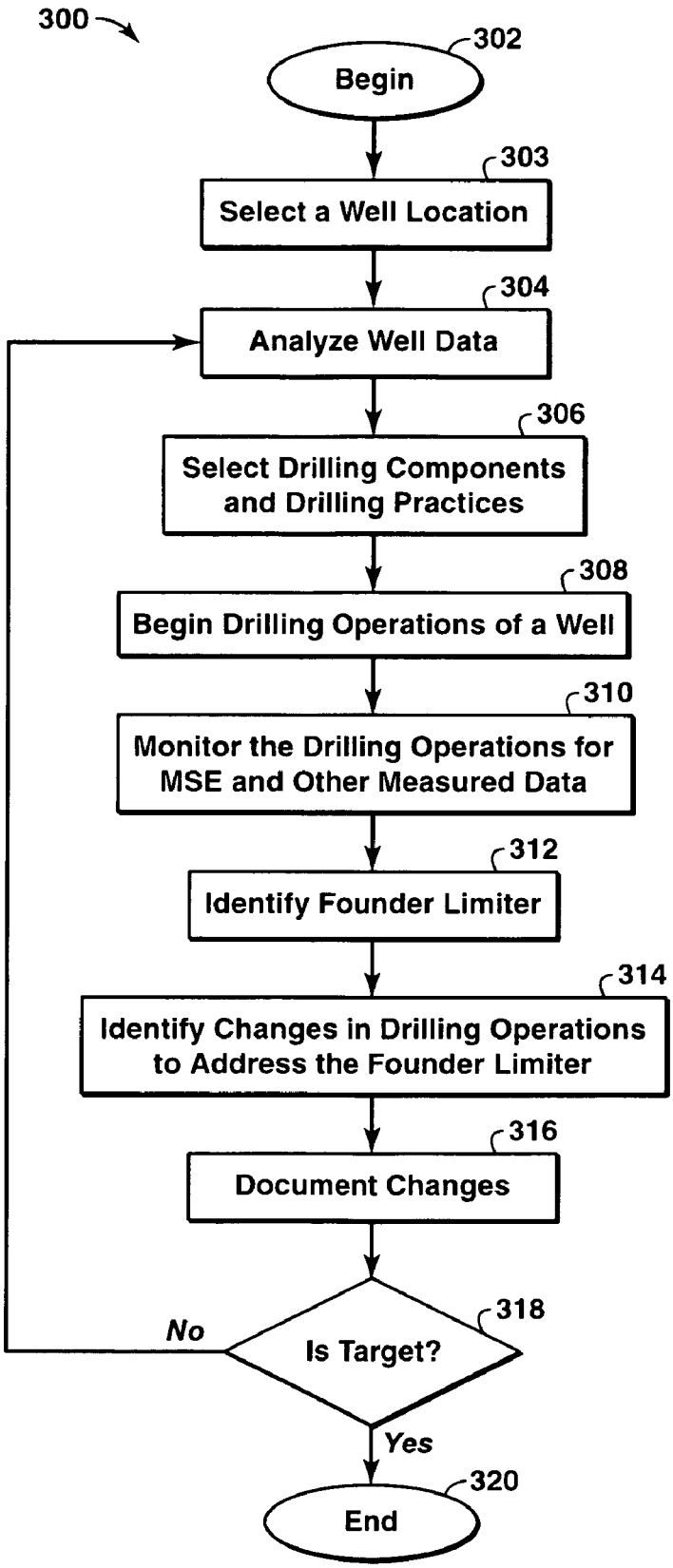
FIG. 3 is an exemplary flow chart of a drilling process utilized for the wells of FIG. 1 in accordance with aspects of the present techniques.

FIG. 3 is an exemplary flow chart of the Fast Drill Process utilized for the wells of FIG. 1 in accordance with aspects of the present techniques. This flow chart, which is referred to by reference numeral 300, may be best understood by concurrently viewing FIGS. 1 and 2. In this flow chart 300, a drilling process may be developed and utilized to enhance the drilling operations by increasing the drilling rate of the wells 104*a*-104*n*. That is, the present technique provides a process that increases the drilling rate or ROP by resolving founder limiters to extend the ROP. Accordingly, drilling operations performed in the described manner may reduce inefficiency by modifying drilling operations based on MSE and other measured data.

The flow chart begins at block 302. At block 303, a well location may be selected. This selection may include typical techniques for identifying a field having hydrocarbons. Then, well data is analyzed, as shown in block 304. The well data may include information relating to rock type, rock properties, MSE, vibration, WOB, RPM, ROP torque, pump pressure, flow, hook weight and/or other measured data, which is discussed further below. The well data, which may include real time, historical and/or previously generated data, may be associated with the well currently being drilled, a previously drilled well in the same field or similar fields, and/or wells being concurrently drilled. With the well data, drilling components and drilling practices may be selected for the well, as shown in block 306. The drilling components may include drill bits, drill string, drill collars, stabilizers, reamers, hole openers, jars, directional steering equipment, downhole measurement tools, vibrations measurement tools, pump liners, surface pressure containment systems, fluid processing equipment, digital drilling data acquisition systems, and rig automatic control systems or the like, which are discussed below further. Similarly, the drilling practices may include performing various tests, such as MSE Weight tests, MSE RPM tests, MSE Hydraulics tests, drilloff tests, and drill rate tests or the like, which are also discussed below further. The selection of drilling components and drilling practices may provide an estimated drill rate for the well.

At block 308, drilling operations may begin. The drilling operations may include setting up the drilling systems 102*a*-102*n*, drilling the wells 104*a*-104*n*, performing drilling practices or tests to optimize the operation or collect data to support future optimization, collecting core samples, running tools to evaluate the formation, installing casing, tubing and completion equipment, conducting post-drill analysis of performance and/or archiving learnings from the drilling operations. During the drilling operations, MSE and other measured data may be monitored at block 310. The monitoring of the MSE and other measured data may be conducted in real-time to provide reactive adjustment of drilling operations. This monitoring may involve transmitting the MSE and other measured data to an engineer located in a geographically remote location or within a trailer near the well. Data may also be displayed at various locations around the rig site. With the MSE and other measured data, founder limits, such as bit balling, vibrations, and bottom hole balling, may be identified, as shown in block 312. The identification of the founder limit may originate from a computer program or a user, such as a drilling operator or engineer, monitoring the MSE and other measured data. This MSE and measured data may be presented via graphical displays to associate the MSE data along with other measured data, such as vibration data, for example.

Based on the identified founder limit, changes in drilling operations may be performed to address a specific founder limiter, as discussed in block 314. These changes or adjustment of the drilling operations include modifying drilling components, and/or drilling practices. For example, changes in drilling operations may include changing drilling components, such as the drill bit 110*a*-110*n*, drill string 112*a*-112*n*, or hydraulic system utilized for the well. Further, the changes in drilling operations may include changes to extend the limits of surface equipment to remove the increased solids load in the drilling fluid, changes in operational practices to improve the ability to rapidly remove drill solids from the well, drilling fluid design changes to enhance the ability of the fluid to seal the borehole in permeable formations when drilling at high drill rates, installation of a low-friction roller reamer in the down hole assembly to reduce certain vibrations, and/or changes in the number of joints of drill collars or heavy weight drill pipe used in the drilling assembly to reduce certain vibrations. Other examples of possible changes are discussed in FIGS. 5A-7K.

Then, changes in the drilling operations may be documented in block 316. The documentation may include storing the changes in drilling operations in a database, server or other similar location that is accessible by other personnel associated with the drilling systems 102*a*-102*n*. Then, a determination is made whether the target depth has been reached, as shown in block 318. The target depth may be a specific subsurface location, such as one of the subsurface reservoir 108*a*-108*n* and/or a predetermined or subsurface location that the well is intended to reach. However, it should be noted that the MSE and other measured data may be utilized while reaming the wellbore for logging, reaming casing to bottom prior to cementing, during workover operations, such as drilling out plugs in a well or other material. That is, the Fast Drill Process may extend through cementing and completion operations, or any subsequent remedial operations for the life of the well or wells within a field. If the targeted depth has not been reached, the well data may be analyzed again in block 304. This re-analysis of the well data may be performed in a continuous manner to extend the ROP by resolving individual founder limiters, as discussed above. This means that the drilling components may be changed one or more times for a well during this process. For instance, the drilling operations may involve two, three, four or more changes to mitigate or remove different founder limiters. However, if the target depth has been reached, then the process to optimize performance on the well may end at block 320. If subsequent or concurrent wells are to be drilled, the stored data may be further analyzed to aid in the selection of drilling components or drilling practices for the other well.

Figure 4:
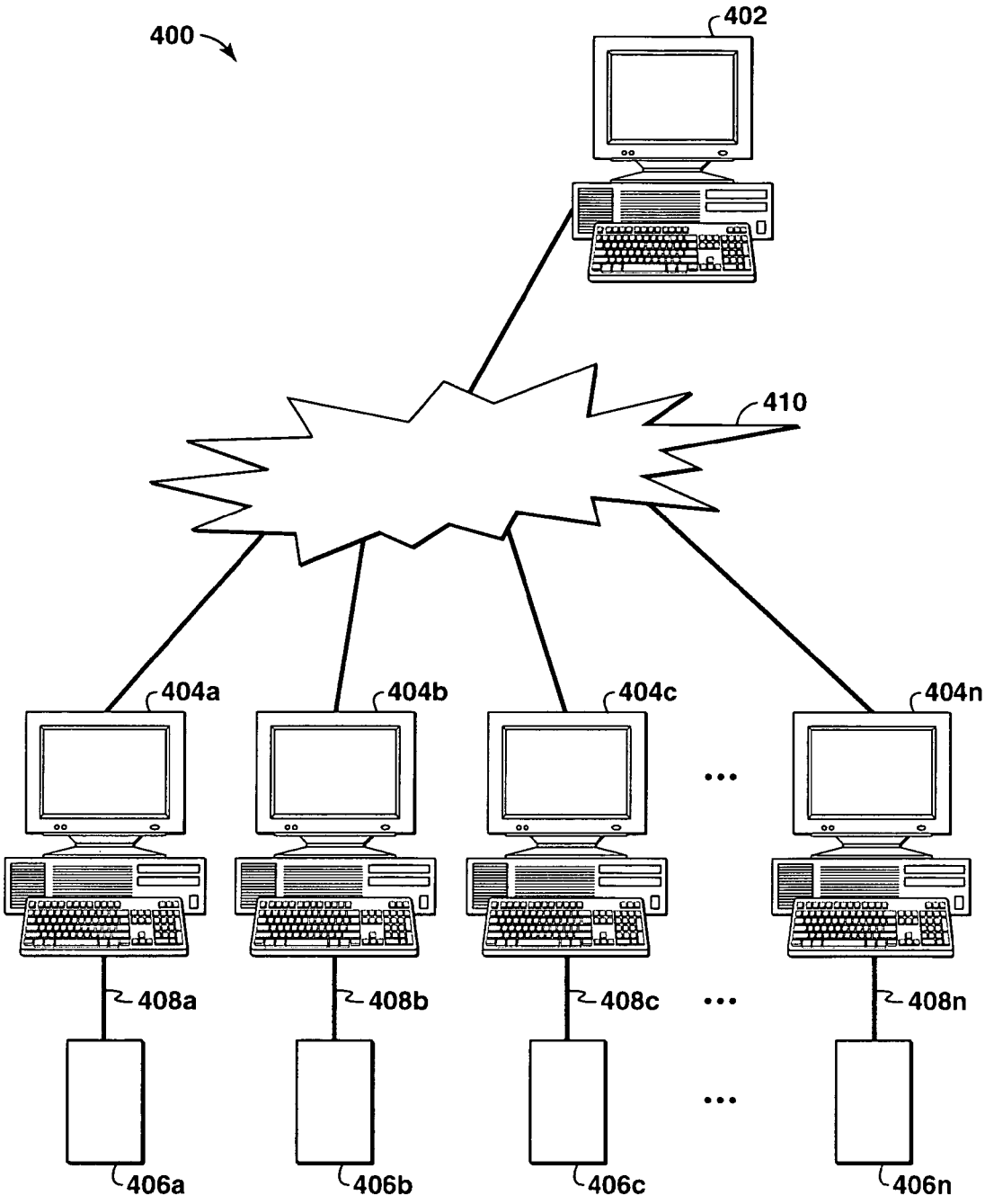
FIG. 4 is an exemplary system utilized with the drilling systems of FIG. 1 in accordance with certain aspects of the present technique.

FIG. 4 is an exemplary system 400 utilized with the drilling systems 102*a*-102*n* of FIG. 1 in accordance with certain aspects of the present techniques. In this system 400, an engineering device 402 and various drilling system devices 404*a*-404*n* may be coupled together via a first network 410. The engineering device 402 may be utilized to monitor one or more of the drilling system devices 404*a*-404*n*, which are each associated with one of the drilling systems 102*a*-102*n* and respective wells 104*a*-104*n*.

The engineering device 402 and drilling system devices 404*a*-404*n* may be laptop computers, desktop computers, servers, or other processor-based devices. Each of these devices 402 and 404*a*-404*n* may include a monitor, keyboard, mouse and other user interfaces for interacting with a user. Further, the devices 402 and 404*a*-404*n* may include applications that allow a user of the respective device to view MSE data along with other measured data, which is discussed further below. For example, contractors who provide equipment and software to monitor downhole or surface drilling data may modify existing systems to also display MSE data along with other footage or time based information. Examples of contractors who may provide this display include logging-while-drilling, downhole vibrations monitoring, mud logging, surface data acquisition, and drilling rig contractors. As such, each of the devices 402 and 404*a*-404*n* may include memory for storing data and other applications, such as hard disk drives, floppy disks, CD-ROMs and other optical media, magnetic tape, and the like.

Because each of the devices 402 and 404*a*-404*n* may be located in different geographic locations, such as different drilling locations, buildings, cities, or countries, the network 410 may include different devices (not shown), such as routers, switches, bridges, for example. Also, the network 410 may include one or more local area networks, wide area networks, server area networks, or metropolitan area networks, satellite networks or combination of these different types of networks. The devices 402 and 404*a*-404*n* may communicate via a first communication media, such as IP, DecNET, or other suitable communication protocol. The connectivity and use of network 410 by the devices 402 and 404*a*-404*n* may be understood by those skilled in the art.

In addition to communicating with each other, each of the devices 404*a*-404*n* may be coupled to one of the measuring devices 406*a*-406*n* via a separate network, such as drilling system networks 408*a*-408*n*. These networks 408*a*-808*n* may include different devices (not shown), such as routers, switches, bridges, for example, which provide communication from one of the measuring device 406*a*-406*n* to the respective device 404*a*-404*n*. These measuring devices 406*a*-406*n* may be tools deployed within the respective wells 104*a*-104*n* to monitor and measure certain conditions, such as RPM, torque, pressure, vibration, etc. For instance, the measuring devices 406*a*-406*n* may include downhole drilling tools used for directional control or logging, such as rotary steerable assemblies, bent housing motors, vibrations monitoring tools, logging-while-drilling tools, surface vibrations monitoring systems and surface sensors placed to monitor a variety of surface activities. These tools may include accelerometers that measure vibrations continuously and in three axes. Accordingly, the devices 404*a*-404*n* and 406*a*-406*n* may communicate via the first communication protocol and/or a second communication protocol to exchange the measured data. The connectivity and use of networks 408*a*-408*n* by the devices 402, 404*a*-404*n* and 406*a*-406*n* may be understood by those skilled in the art.

Beneficially, the use of these devices 402 and 404*a*-404*n* may provide a user with the MSE data and other measured data, which is discussed above. To further describe the presentation and use of the MSE and other measured data, various specific examples are provided below. In these examples, the use of real-time MSE data may be used along with other measured data to determine a founder limiter for a drilling system, such as one of the drilling systems 102*a*-102*n*. In particular, FIGS. 5A-5D describe the monitoring of a drilling system that encounters bit balling, while FIG. 6 describes the monitoring of a drilling system that encounters bottom hole balling. FIGS. 7A-7K describe the monitoring of a drilling system that encountered various vibration limiters and bit dulling limiters.

Accordingly, as the MSE curve is the relationship of the RPM and WOB, the inputs to the equation may be measured by measuring device 406*a* and provided to the drilling system device 404*a* via the network 408*a*. As drilling progresses, the calculated MSE curve is displayed along with other measured data, such as RPM, torque, ROP, WOB, pump pressure and/or flow-in in the form of curves. Each of these curves may be generated on time-based or footage-based scales (i.e. depth) and displayed on a monitor associated with the drilling system 102*a*. Alternatively, these curves may also be provided to offsite personnel, such as a drilling engineer using the device 402 in 15 second updates. Accordingly, FIGS. 5A-7K may be best understood by concurrently viewing FIGS. 1 and 4.

Figure 5A:
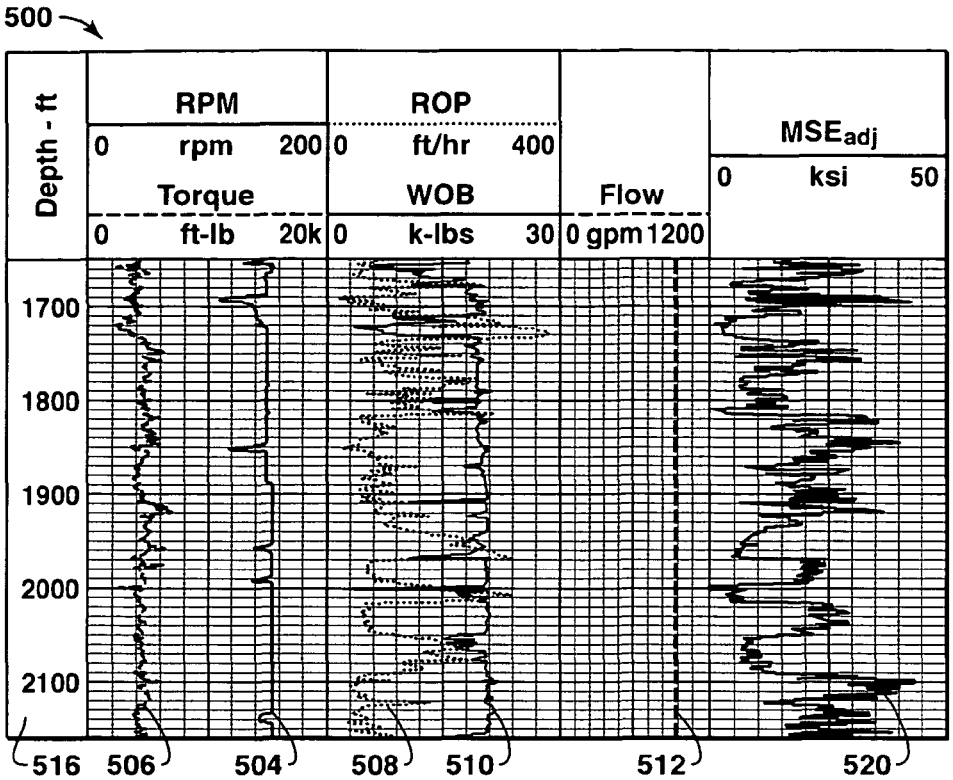
FIGS. 5A-5D are exemplary charts provided in the drilling system of FIG. 1 associated with bit balling in accordance with certain aspects of the present technique.

FIG. 5A is an exemplary chart of MSE data displayed along with other measured data to a user at the drilling system 102*a*. In this chart, which is herein referred to by reference numeral 500, the MSE curve 502 is displayed along with other measured data, such as a RPM curve 504, torque curve 506, ROP curve 508, WOB curve 510 and flow-in curve 512 along a depth scale 516. These curves 502-512 are utilized together to identify bit inefficiency and increase the drilling rate. Alternative displays may also include curves showing additional data such as vibrations, hook position, downhole circulating pressure, and down hole temperature.

In FIG. 5A, an interval of well 104*a* is drilled in the same manner as the offsets drilled previously. The interval is drilled with the drill bit 110*a* being an IADC 1-1-7-tooth bit, 20 klbs (kilo-pounds) WOB, and a water-based mud. The layers of rock being drilled are soft, with rock strengths in both the sands and shales of 3-5 ksi (kilo pounds per square inch) If the drill bit 110*a* was efficient, the MSE curve 502 should be a straight line with a value of about 3-5 ksi. Instead, the MSE curve 502 increases to values exceeding 25 ksi in the shales and decreases to 5 ksi in the sands. As a result, the drilling system 102*a* utilizes the same amount of energy to drill the shales as rocks with a compressive strength of about 25 ksi, though the rock strength is 3-5 ksi. This indicated bit inefficiency or wasted energy, which may be addressed by corrective action by the operator.

Under the present techniques, a determination is made based upon the MSE and measured data to enhance drilling operations in this and other subsequent wells, such as wells 104*b*-104*n*. For instance, because the build up of shale cuttings on its surface is cleared when the drill bit 110*a* enters the sand, the cutting structure becomes efficient again and the ROP climbs back to about 350 fph, while the MSE curve 502 decreases to values that are close to the rock strength. Accordingly, the founder limiter for this drilling system 102*a* appears to be bit balling because the cutting structure appears to be filled with debris in the shales, which tend to stick to the drill bit while the bit cleans properly in the sands. By re-designing the drilling components to utilize a polycrystalline diamond compact (PDC) bit and enhanced hydraulics, the subsequent drilling systems, such as drilling systems 102*b*-102*n* may increase their drilling rates in subsequent wells, such as wells 104*b*-104*n*.

Figure 5B:
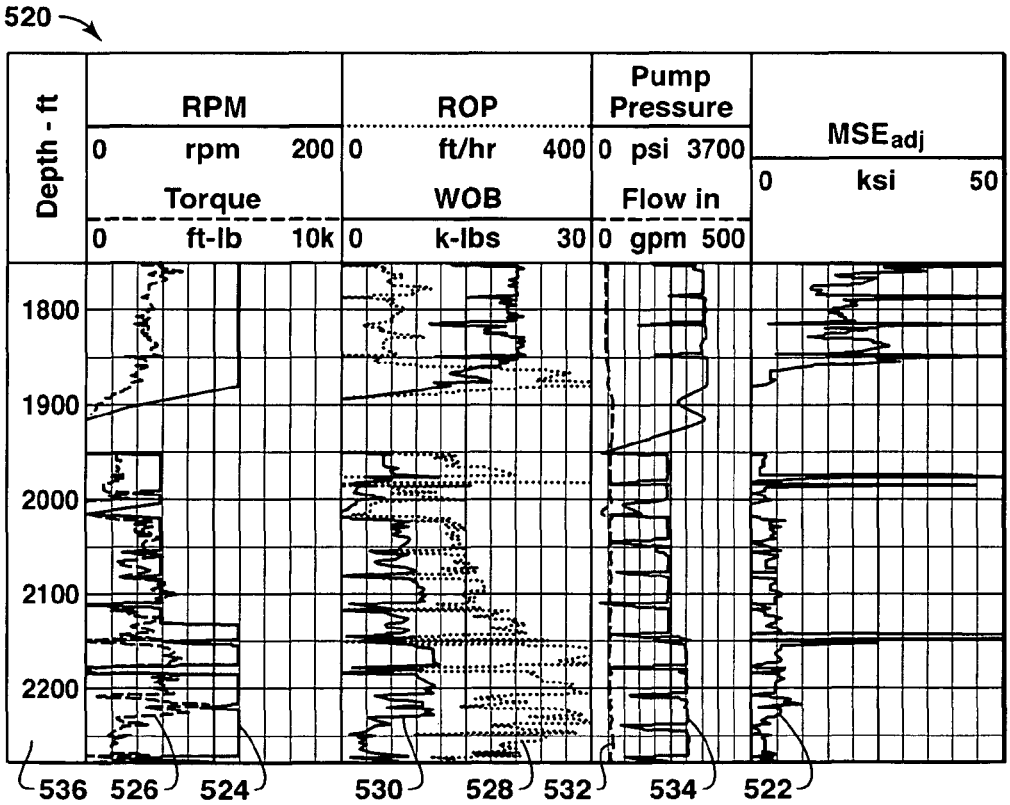

As a second example, the MSE and other measured data may be utilized with methodical tests to increase the drilling rate of a well, such as well 102*a*, shown in FIG. 5B. FIG. 5B is a second exemplary chart provided in the drilling system of FIG. 1 for bit balling foundering in accordance with certain aspects of the present technique. In this chart, which is herein referenced by reference numeral 520, methodical tests are utilized as part of the drilling practices to identify founder limiters for the drilling system 102*a*. In FIG. 5B, the MSE curve 522 is displayed along with other measured data, such as a RPM curve 524, torque curve 526, ROP curve 528, WOB curve 530, pump pressure curve 532 and/or flow-in curve 534 along a depth scale 536. Each of these curves 522-534 is utilized together along with the methodical tests to identify bit balling limiters and increase the drilling rate.

In FIG. 5B, an interval of well 104*a* is drilled after the drilling out of surface casing with an 8½" bit in water-based mud. In this well 104*a*, an "MSE Weight Test" was conducted from around 2000 ft (feet) to about 2100 ft, which raised the WOB from 5 klbs to 11 klbs in 2 klb increments, and an "MSE RPM Test" was then conducted from about 2130 ft to 2300 ft by raising the rotary speed from 60 to 120 RPM. With regard to the MSE Weight Test, the MSE curve 522 was observed for increases in the MSE values corresponding to increases in the WOB curve 530 that may indicate that the drilling system 102*a* has reached a founder limiter. With the MSE RPM Test, the MSE curve 522 was observed for increases in the MSE values corresponding to increases in the RPM curve 524 that may indicate that the drilling system 102*a* has reached a founder limit.

Based on these tests, it is clear that the MSE curve 522 is unchanged during MSE Weight Test and MSE RPM Test. That is, the drill bit 110*a* was operating at the same efficiency levels at 100 fph and 200 fph with the different WOB and up to 400 fph with the different RPMs. As such, these methodical tests establish that the drill bit is still performing efficiently and is operating below the founder point. In addition to confirming that the drill bit is still efficient, the low MSE demonstrates that a further increase in WOB is likely to yield a linear increase in ROP. However, the high values in the MSE curve 522 at around 1800 ft with the previous drill bit are indicative that the teeth on the drill bit 110*a* are bit balling in the shales. As such, the hydraulics on the drilling system 102*a* may be modified on this or subsequent wells to increase the drilling rates to over 500 fph throughout the production wellbore. Accordingly, the methodical tests may be utilized along with the MSE data and other measured data to further enhance the drilling operations. If the MSE does not change when WOB or RPM is adjusted, the drilling system is shown to be efficient and the WOB is increased further. If the MSE exhibits an incremental change that exceeds the potential change in rock compressive strength when the WOB or RPM is adjusted, the drill bit is known to be in founder and corrective action may be taken by the operators of the drilling system. Equipment and systems may also be modified as the opportunity arises.

Figure 5C:
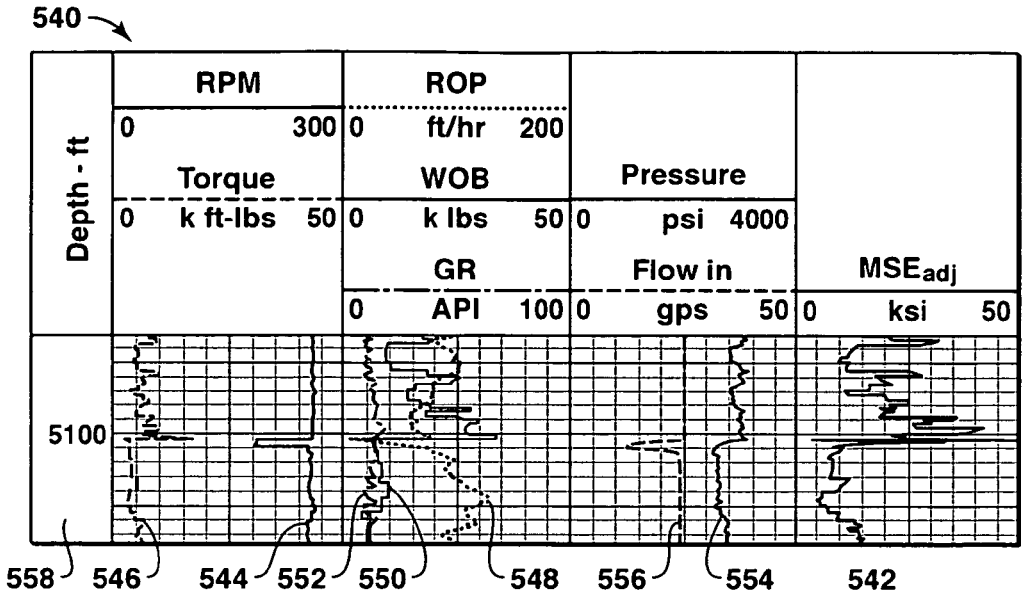

As a third example, FIG. 5C is a third exemplary chart provided in the drilling system of FIG. 1 for bit balling foundering in accordance with certain aspects of the present technique. In this chart, which is herein referenced by reference numeral 540, moderate bit balling was identified as the founder limiter for the drilling system 102*a*. In FIG. 5C, the MSE curve 542 is displayed along with other measured data, such as a RPM curve 544, torque curve 546, ROP curve 548, WOB curve 550, gamma ray (GR) curve 552, pump pressure curve 554 and/or flow-in curve 556 along a depth scale 558. Each of these curves 542-556 are utilized together to identify bit balling foundering limiters and increase the drilling rate.

In FIG. 5C, the MSE curve 542 is shown for an interval of well 104*a* that is a 12¼" interval. In this example, the drilling system 102*a* is using the same amount of energy as if this soft rock had a compressive strength of 25 ksi. At round 5100 ft, the operators determined that the energy loss was a result of moderate bit balling and reduced the WOB from about 25 klbs to about 8 klbs. The MSE curve 542 decreased after the modification of the WOB, which is indicative of an increase in the bit efficiency, and the ROP increased from about 80 fph to about 100 fph. By using the MSE data and other measured data, the operator was able to increase the drilling rate by utilizing the MSE as an indicator of performance.

In this example, the operators of the drilling system 102*a* were able to utilize the MSE data and other measured data to determine certain levels of performance for the drilling operations. Then, the operators may adjust operating parameters and observe changes on the MSE curve 542. Accordingly, the operating parameters may again be adjusted to settings at which MSE curve 542 is at or near a minimum value.

With the operating parameters optimized for a MSE, engineering redesign of the drilling system 102*a* may be reviewed to provide further enhancements to the drilling rate or ROP, as discussed above. For instance, after the operators determined that bit balling occurred in the soft limestones, drilling components, such as nozzles and flow rates, are modified to achieve the highest hydraulic horsepower per square inch (HSI) possible with the available drilling equipment. The hydraulic horsepower at the drill bit may be changed by either increasing the volume of flow through the drill bit, or reducing the nozzle size so the pressure drop and velocity for a given flow are increased. Both modifications consume the available pump horsepower. In general, flow rate is emphasized in directional wells where hole cleaning is the priority. In this example, because the pumps were already operating at their contract horsepower output when bit balling was observed, the flow rate was reduced to allow the nozzle pressure drop and HSI to be increased. With improved hydraulics, the founder point for bit balling has now been elevated to allow consistent application of 25-45 k lbs WOB in contrast to 5-25 k lbs previously.

Figure 5D:
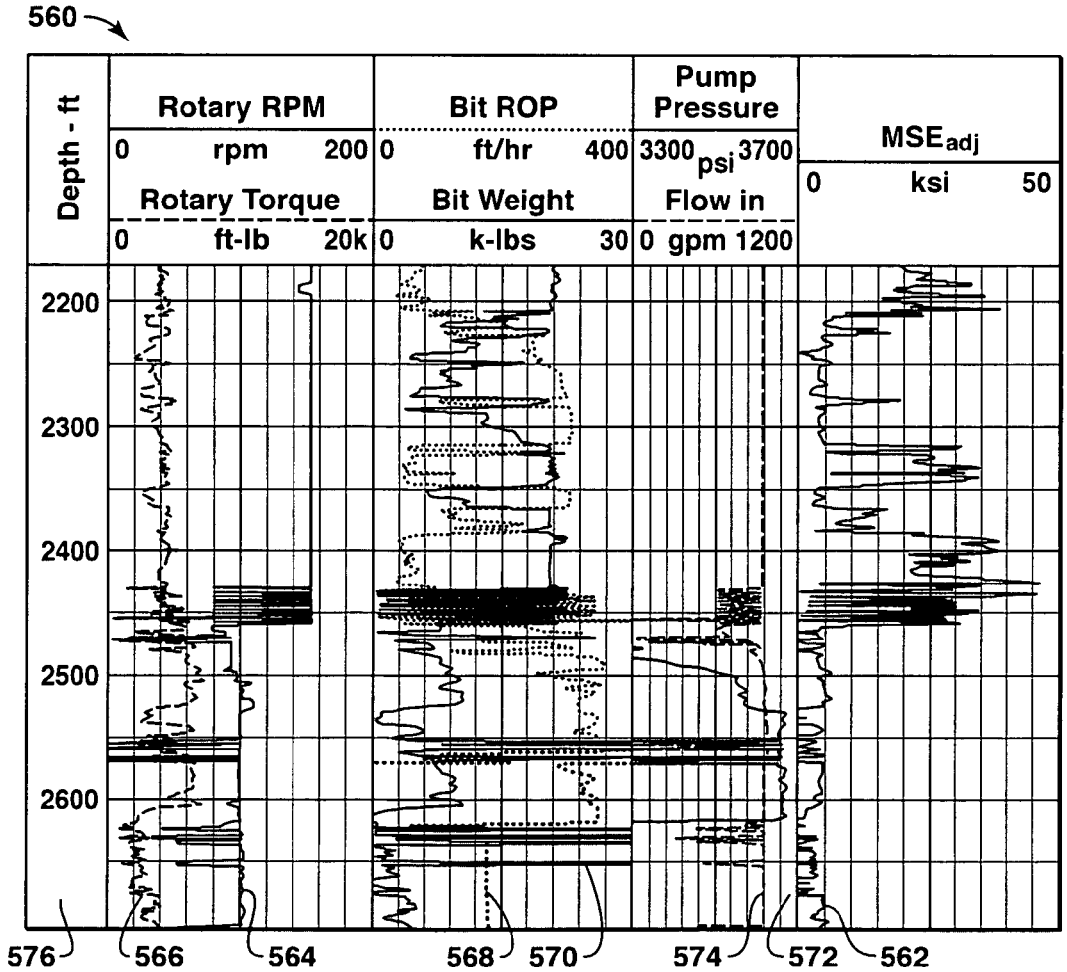

As a fourth example, FIG. 5D is a fourth exemplary chart provided in the drilling system of FIG. 1 for bit balling foundering in accordance with certain aspects of the present technique. In this chart, which is herein referenced by reference numeral 560, bit balling was again detected as a founder limiter for the drilling system 102*a*. In FIG. 5D, the MSE curve 562 is displayed along with other measured data, such as the RPM curve 564, torque curve 566, ROP curve 568, WOB curve 570, pump pressure curve 572 and/or flow-in curve 574 along a depth scale 576. Each of these curves 562-574 are again utilized together to identify for bit balling foundering limiters and increase the drilling rate.

In FIG. 5D, the MSE curve 562 is shown for an interval of well 104*a* with the drilling system 102 using a drill bit 110*a* and a hydraulic system set for an initial HSI of 5.2 hp/in$^2$ (horsepower per squared inch). The well 104*a* had previously been drilled at a record rate with an average ROP of around 150 fph. However, because operators observed that the MSE curve 562 had increased values for certain depths between 2200 ft to 2400 ft, the operators determined that the drill bit 110*a* was bit balling. Accordingly, a replacement drill bit was utilized that included hydraulics having a nozzle for an HSI of 11.5 hp/in$^2$. After the redesign of the hydraulics, the MSE curve 562 from between 2400 ft and 2600 ft was observed to be approximately equal to the rock compressive strength. This change in the MSE curve 562 indicates that the cutting structure was clean because of the redesigned hydraulics. As a result, the ROP increased in sands and shales to more than about 350 fph for the next 3000 ft.

Figure 6:
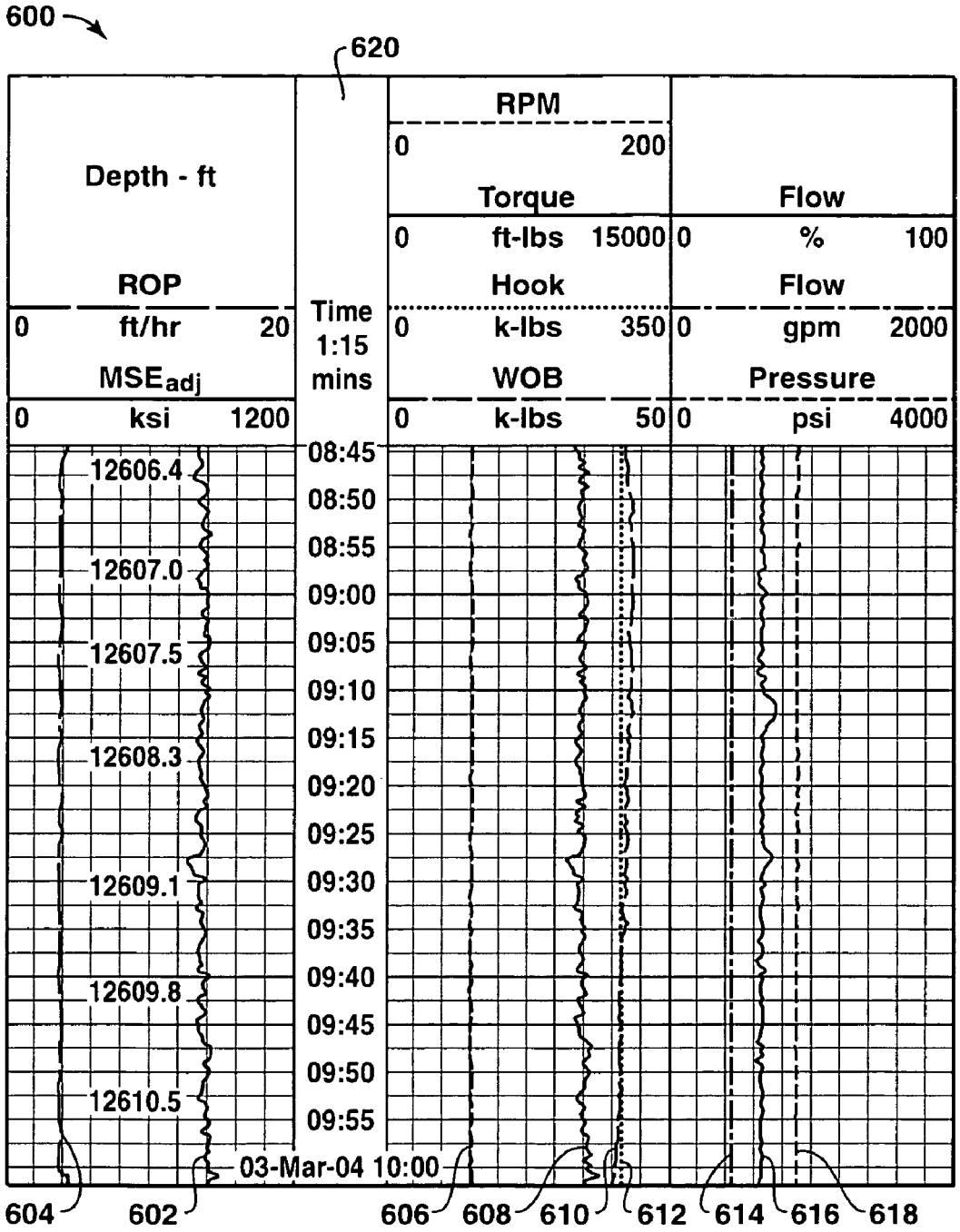
FIG. 6 is an exemplary chart provided in the drilling system of FIG. 1 associated with bottom hole balling in accordance with certain aspects of the present technique.

FIG. 6 is an exemplary chart provided in the drilling system of FIG. 1 for bottom hole balling in accordance with certain aspects of the present technique. In this chart, which is herein referenced by reference numeral 600, MSE and other measured data are utilized with different hydraulics to determine founder limiters for the drilling system 102*a*. In FIG. 6, the MSE curve 602 is displayed along with other measured data, such as a ROP curve 604, RPM curve 606, torque curve 608, WOB curve 610, hook curve 612, pump pressure curve 614, flow percentage curve 616, and/or flow-in curve 618 along a time line 620. Each of these curves 602-618 are again utilized together to identify founder limiters and increase the drilling rate.

In FIG. 6, the MSE curve 602 is shown for an interval of the well 104*a* that has a drill bit 110*a*, which is a 7⅞" insert bit.

This drill bit 110*a* is drilling in a subsurface formation having rock strength of 25 ksi with a water-based mud. In this chart 600, the MSE curve 602 is elevated to about 800 ksi, which indicates that a founder limiter is restricting the ROP. Because bit balling does not typically occur in very hard rock and the MSE curve 602 does not exhibit sporadic oscillations that typically indicate vibration, the founder limiter is likely to be bottom hole balling. That is, the drill bit 110*a* appears to be rotating on material that is held at the bottom of the wellbore by differential pressure and is not actually in contact with the rock beneath the finely ground material. The drilling system was replaced on a subsequent well with a different type of drill bit and a high speed turbine, which is a more effective system for bottom hole balling conditions. Surveillance of the MSE curve allowed the nature of the problem to be understood, and quantifying the severity enabled another drilling system to be cost-justified.

In addition to the bottom hole balling and bit balling examples discussed above, vibrations are another founder limiter that introduces inefficiency into the drilling system. As noted above, vibrations tend to generate wide variations in torque and MSE. Vibrations are one of the leading founder limiters that restrict the drilling rate and monitoring the vibration data with MSE data may further enhance the drilling process.

For instance, the operator of the drilling system 102*a* may modify drilling parameters, such as WOB, rotary speed or other operational parameters, to an efficient level to mitigate the vibration effects. The addition of MSE data allows the operator to clearly determine the effect of vibrations on the drilling system's efficiency and provides an additional perspective on changes in drilling components. That is, the MSE data may be utilized to identify design changes to reduce or constrain the vibrations influence on limiting the drilling rate for the well. Different types of vibration founder and bit dulling are discussed in following examples associated with FIGS. 7A-7K.

Figure 7A:
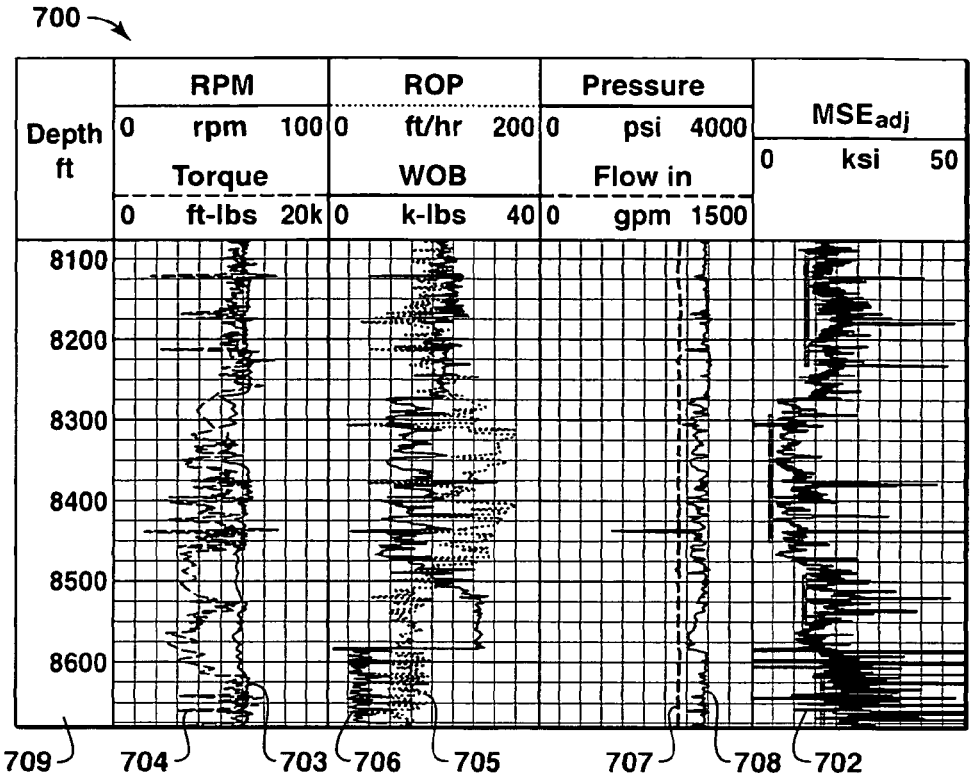
FIGS. 7A-7K are exemplary charts provided in the drilling system of FIG. 1 for vibration foundering and bit dulling foundering in accordance with certain aspects of the present technique.

FIG. 7A is a first exemplary chart provided in the drilling system of FIG. 1 for vibration foundering in accordance with certain aspects of the present technique. In this chart, which is herein referenced by reference numeral 700, MSE and other measured data are utilized to determine vibration founder limiters for the drilling system 102*a*. In FIG. 7A, the MSE curve 702 is displayed along with other measured data, such as a RPM curve 703, torque curve 704, ROP curve 705, WOB curve 706, pump pressure curve 707, and/or flow-in curve 708 along with depth scale 709. Each of these curves 702-708 are again utilized together to identify founder limiters and increase the drilling rate.

FIG. 7A shows a series of MSE Weight and MSE RPM tests are performed in 5 ksi to 10 ksi rock. This example demonstrates some commonly observed vibration behaviors, which is indicated from the MSE curve 702 and drilling tests that involve changing the WOB. As shown in this chart 700, the values of the MSE curve 702 were initially about 30 ksi to about 40 ksi from 8100 ft to 8270 ft. When the WOB was decreased at 8270 ft, the values on the MSE curve 702 decreased to a range between 15 ksi to 25 ksi and the values of the ROP curve 705 increased. The values of the WOB curve 706 was then increased to its original value at 8500 ft, which resulted in the values of the MSE curve 702 increasing and the values of the ROP curve 705 decreasing. At 8580 ft, the WOB was decreased, and the values of the MSE curve 702 increased above the previous levels.

The changes in the WOB during the drilling operations provided the operators with valuable information about the drilling system's performance. For instance, the changes in the WOB from 8100 ft to about 8500 ft indicate that the vibration founder was occurring and returned with the adjustment to the WOB. Further, the lowering of the WOB from 8500 ft to 8650 ft indicates that an inadequate depth of cut (DOC) or severe whirl was occurring within the well 104*a*. From the drilling tests, the highest ROP values are provided in a range from about 12 klbs to 15 klbs. Further, the drilling tests indicate that vibration mitigation was the cause of the change in ROP and not changes in rock strength because the rock strength could not have declined by 15 ksi. Accordingly, to increase the drilling rate further, a drilling components design change may be performed to eliminate or constrain vibrations at a WOB higher than 15 klbs.

Figure 7B:
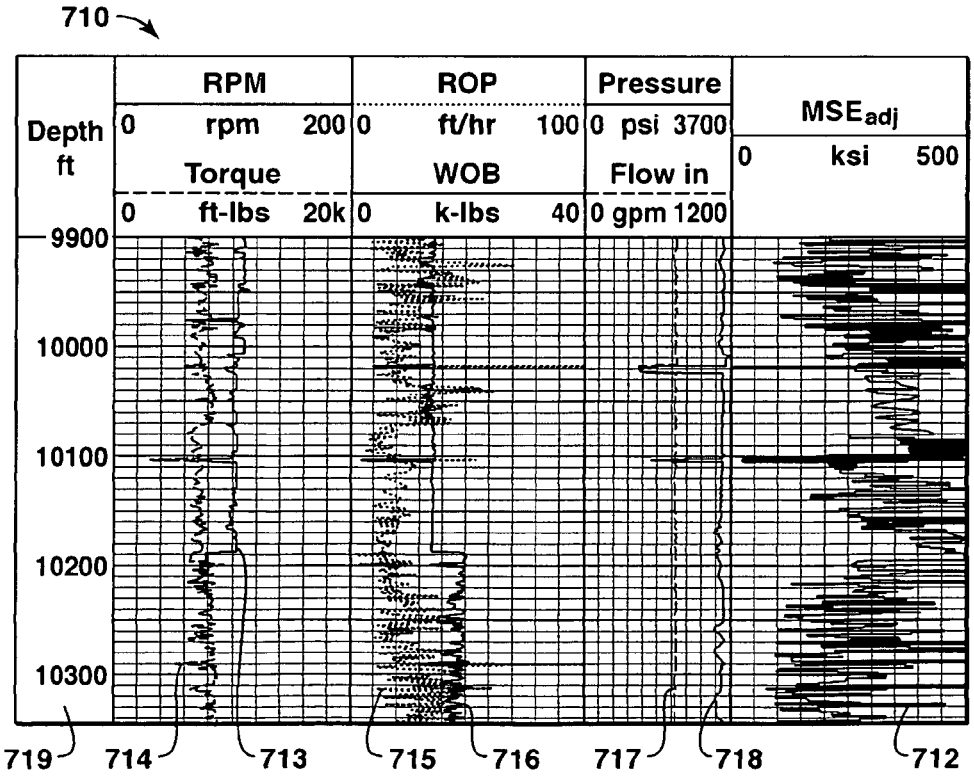

FIG. 7B shows a second example of using the MSE data along with other measured data to determine vibration foundering limiters. In FIG. 7B, a chart, which is herein referenced by reference numeral 710, is presents MSE and other measured data that are utilized to determine vibration founder limiters for the drilling system 102*a*. In FIG. 7B, the MSE curve 712 is displayed along with other measured data, such as a RPM curve 713, torque curve 714, ROP curve 715, WOB curve 716, pump pressure curve 717, and/or flow-in curve 718 along a depth scale 719. Each of these curves 712-718 are again utilized together to identify vibration foundering limiters and increase the drilling rate.

FIG. 7B includes MSE WOB and MSE RPM tests utilized to evaluate the performance of the drilling operations in a formation having rock strength in a range of 5 ksi to 10 ksi. In this example, the well 102*a* is a 8½' wellbore within rock having a 5 ksi compressive strength rock. The MSE curve 712 is initially about 250 ksi with spikes of up to about 500 ksi from 9900 ft to 10100 ft. As part of the MSE WOB test, the WOB was increased and the rotary speed decreased at around 10200 ft, which is a typical operational to mitigation for whirl vibrations. As a result of this test, the values of the MSE curve 712 decreased and values of the ROP curve 715 increased.

The changes in the WOB and RPM during the drilling provided the operators with valuable information about the performance of the drilling system. The nature of the vibrations is determined from the manner in which the MSE responds to these changes in drilling parameters. For instance, the MSE curve 712 from 9900 ft to 10200 ft indicates a high energy loss, but it does not indicate the specific nature of the vibrations. It was not know that whirl was the cause until the WOB was increased and the MSE declined, which is the expected response if the initial condition was whirl. If the initial condition had been dominated by stick-lip vibrations, the MSE and vibration energy loss would have increased. Some of the ROP response may be explained without the MSE curve 712 because ROP values normally increases with increased WOB in a proportionate relationship. However, the ROP response is disproportionately high in the range from 10200 ft to 10350 ft, and the values of the MSE curve 712 decreased along this same range. Accordingly, the MSE curve 712 and values on the WOB curve 716 and ROP curve 715 indicate that the drill bit did not simply drill faster due to increased WOB, but was more efficient. Thus, the MSE WOB and MSE RPM testing may be performed to mitigate vibration foundering or provide further justification for modifying the drilling system to increase the drilling rate.

In this example, a baseline trend may be observed in the MSE curve 712 in which the MSE values are generally increasing with depth. This increase is due to the increased drill string friction as the cumulative contact between pipe and borehole wall increased with depth. When large frictional losses are present, the MSE values may exceed rock strength.

This does not detract from the use of the MSE data because in the method described the MSE data is used only as a relative indication of efficiency and with other measured data. If changes are made in operating parameters and the MSE declines or increases, the process has become more or less efficient. Thus, the relative response of the MSE values are used to assist with operational decisions, and not its absolute value.

Figure 7C:
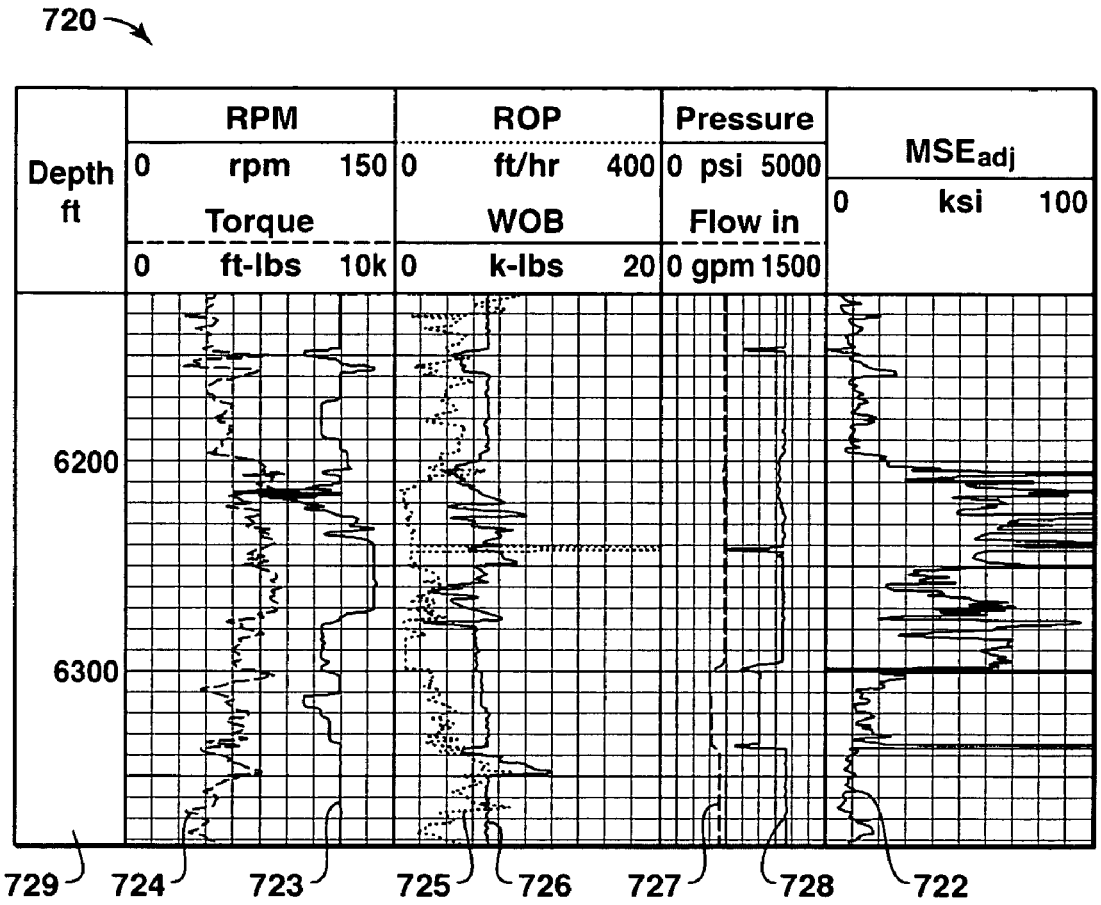

FIG. 7C shows a third example of using the MSE data along with other measured data to determine vibration foundering limiters. In FIG. 7C, a chart, which is herein referenced by reference numeral 720, presents MSE and other measured data that are utilized to determine vibration founder limiters for the drilling system 102*a*. In FIG. 7C, the MSE curve 722 is displayed along with other measured data, such as a RPM curve 723, torque curve 724, ROP curve 725, WOB curve 726, pump pressure curve 727, and/or flow-in curve 728 along a depth scale 729. Each of these curves 722-728 are again utilized together to identify vibration foundering limiters and increase the drilling rate.

FIG. 7C includes MSE WOB and MSE RPM tests utilized to evaluate the drilling operations in a formation having rock strength in a range of about 1 ksi to 10 ksi. In this example, whirl vibrations occur when a drill bit 110*a*, which was an aggressive PDC drill bit, encounters a first interval of rock having a rock strength from around 3 ksi to 8 ksi. In the first interval, the values of the MSE curve 722 increased by over 50 ksi, indicating the onset of vibration foundering. The operator increased the WOB to maintain ROP levels. This adjustment severely damaged the drill bit 110*a* within 100 ft of drilling. Caliper logs collected by the drilling system 102*a* for this interval indicated that an oversized wellbore was formed in this interval by a whirling drill bit.

In subsequent drilling operations in the same well 104*a*, another formation of rock having similar properties was encountered 500 ft deeper than the first interval. Based on the MSE curve 722, the WOB and RPM values were decreased to prevent damage to the drill bit 110*a*. After the MSE curve 722 indicated that the drilling operations penetrated the second interval, drilling parameters were returned to the previous levels to resume drilling operations at the optimal levels for the well 104*a*. When the drill bit 110*a* was pulled from the well 104*a* after the target depth was reached, the drill bit 110*a* did not appear to be damaged. As such, the use of the MSE data along with the other measured data may be useful to indicate specific intervals that provide foundering limiters.

Figure 7D:
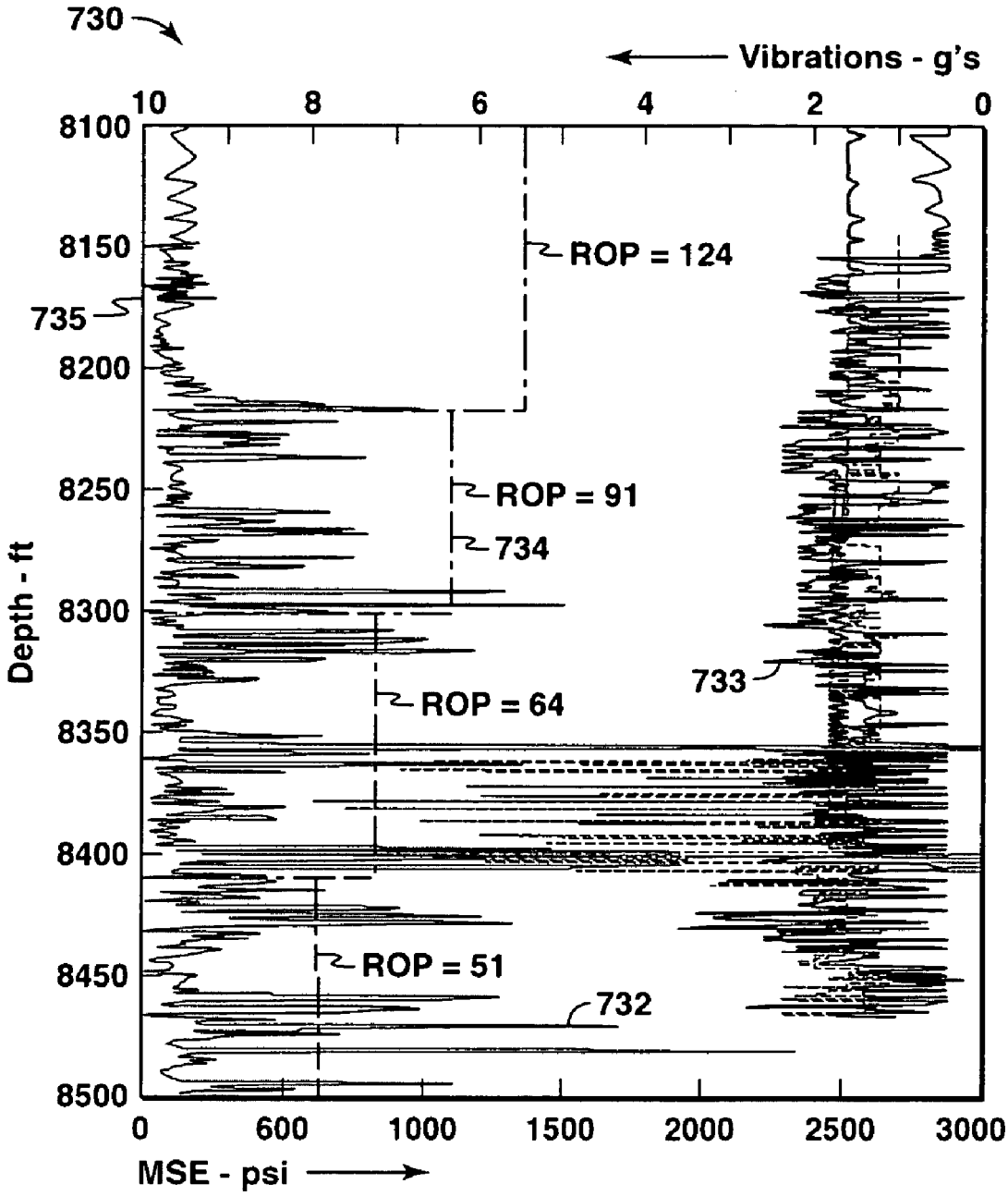

FIG. 7D shows a fourth example of using the MSE data along with other measured data to determine vibration foundering limiters. In FIG. 7D, a chart, which is herein referenced by reference numeral 730, presents MSE and other measured data are utilized to determine vibration founder limiters for the drilling system 102*a*. In FIG. 7D, the MSE curve 732 is displayed with a vibrations curve 733 and ROP curve 734 along a depth scale 735. Each of these curves 732-734 are utilized together to identify vibration foundering limiters and increase the drilling rate.

FIG. 7D includes other aspects of the present techniques that may utilize the MSE curve 732 with the vibration curve 733 to enhance the drilling rate. Until recently, few vibration monitoring tools transmitted vibration warnings until accelerations of 25-50 g's (gravity) were observed because the vibrations at that level may damage drilling components or tools. Consequently, many operators are generally not aware that that the vibrations may limit the ROP. Further, while bit balling is easy to recognize and may be mitigated with a variety of techniques, vibrations are often more subtle and difficult to distinguish from changes in rock compressive strength. Also, vibration tendencies may change with lithology, the hydrostatic head of the drilling fluid, and other factors, which may involve frequent changes in WOB and RPM. This complexity, which may involve continuous testing and analysis of complex relationships, results in vibrations being difficult to detect and properly address by redesigning the drilling system.

In this example, as shown in the vibration curve 733, the amplitude of the vibrations that may reduce values of the ROP curve 734 may be small. A correlation between the MSE curve and vibration curve 733 is clearly shown in depths from 8200 ft to 8450 ft. The vibration levels causing the inefficiency are generally less than 3 g's. In particular, the vibration amplitudes at the depths from 8350 ft to 8400 ft are relatively high, while the values of the MSE curve 732 remains relatively low. These amplitude variations may be an indication of stick-slip, which may be a form of torsional vibrations, as discussed above. Accordingly, the combination of vibration data and MSE data provides the technical understanding of the founder limiter, which is not always evident from an evaluation of vibration data and MSE data separately. Accordingly, based on the combination of this type of information, design changes to the drilling components may be cost justified to increase the drilling rates.

Figure 7E:
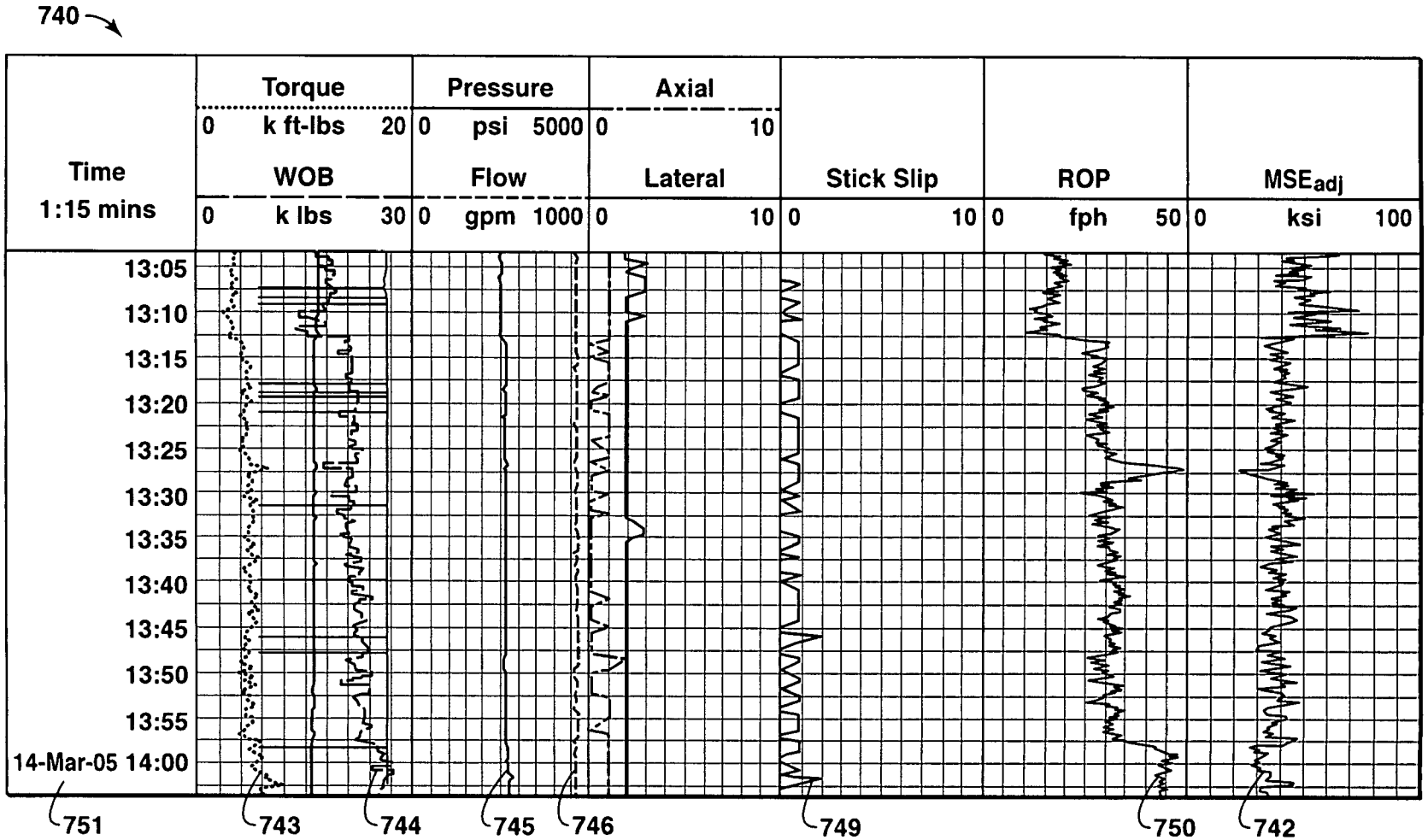

FIG. 7E shows a fifth example of using the MSE data along with other measured data to determine vibration foundering limiters. In FIG. 7E, a chart, which is herein referenced by reference numeral 740, is presents MSE and other measured data that are utilized to determine vibration founder limiters for the drilling system 102*a*. In particular, the MSE curve 742 is displayed along with other measured data, such as a torque curve 743, WOB curve 744, pump pressure curve 745, flow-in curve 746, axial vibration curve 747, lateral vibration curve 748, stick slip vibration curve 749 and/or ROP curve 750 along with a time line 751. Each of these curves 742-750 are again utilized together to identify vibration foundering limiters and increase the drilling rate.

FIG. 7E includes other aspects of the present techniques that may utilize the MSE curve 742 along with vibration data, such as axial vibration curve 747, lateral vibration curve 748 and stick slip vibration curve 749, to analysis and identify vibration foundering. In this example, the drilling system 102*a* includes a measuring device 406*a*, which is a downhole vibrations monitoring system that has been modified to display MSE data along with real time vibration data. Initially, the values of the MSE curve 742 are about 50 ksi in rock with a compressive strength less than 30 ksi. These elevated MSE values may be associated with drill string drag in a directional well. Accordingly, adjusting operating parameters may provide clarification to determine whether the drill bit is efficient. At a time of 13:12 hrs on the time line 751, the WOB increases from 12 klbs to 14 klbs, which results in the values of the MSE curve 742 decreasing from 50 ksi to about 40 ksi and the values of the ROP curve 750 increasing. In addition to these changes, the values of the lateral vibration curve 748 also decrease once the WOB was adjusted. As the WOB gradually increases from 13:12 hrs (hours) to 13:57 hrs on the time line 751, the values of the MSE curve 742 continued to decrease along with the WOB. Then, at 13:57 hr on the time line 751, the WOB increases with the values of the MSE curve 742 decreasing and the values of the ROP curve 750 increasing.

In this example, the changes in the MSE curve 742, lateral vibration curve 748, and ROP curve 750 indicate that the founder limiter is whirl. In particular, the response of the curves to changes in the WOB indicate that the drill bit 110*a* was initially foundering and became more efficient as WOB increased. If the drill bit efficiency had not changed, the values of the MSE curve 742 should not have changed. Also, the changes in the values of the ROP curve 750, which is about 100%, are disproportionate to the increases in the values in the WOB curve 744, which is about 16%. This disproportionate increase is a result of the drill bit becoming fundamentally more efficient at the increased WOB. Further, the values of the lateral vibration curve 748 confirm an initial level of whirl, which was reduced to a minimum level when the WOB increases. It should also be noted that the downhole vibrations monitoring tools are not set up to report the low levels of drill bit vibration that is common to LWD tools. The advantage of downhole accelerometers is a clear indicate of the type of vibration that is occurring, while some experimentation is utilized to determine the vibration type from the MSE curve 742. However, the MSE curve 742 clearly presents the degree that the vibration is affecting drilling performance. As such, the use of the MSE curve along with vibration curves, such as the axial vibration curve 747, lateral vibration curve 748 and stick slip vibration curve 749, are complementary.

Figure 7F:
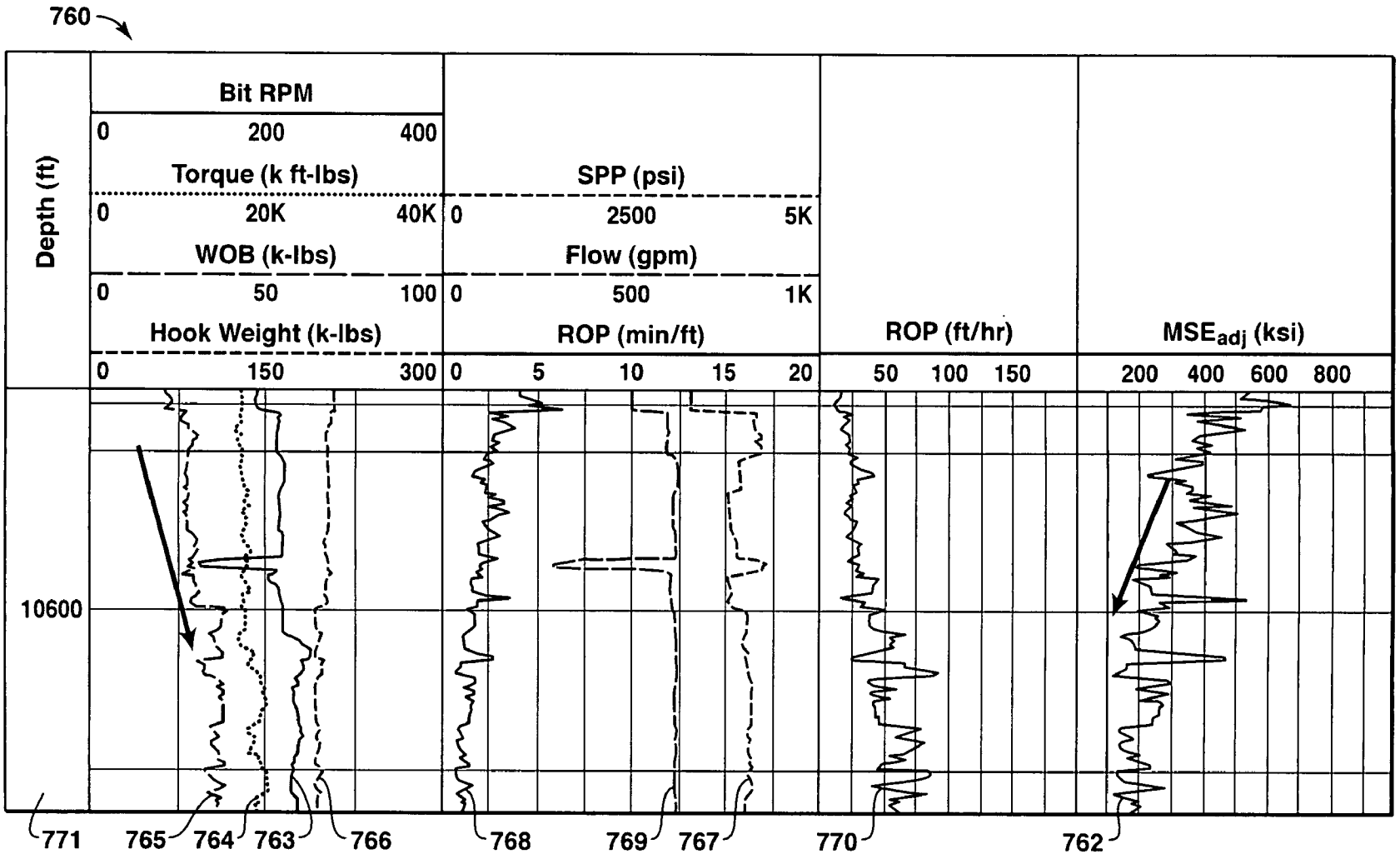

FIG. 7F shows a sixth example of using the MSE data along with other measured data to determine vibration foundering limiters. In FIG. 7F, a chart, which is herein referenced by reference numeral 760, includes MSE and other measured data that are utilized to determine vibration founder limiters for the drilling system 102*a*. In particular, the MSE curve 762 is displayed along with other measured data, such as a bit RPM curve 763, torque curve 764, WOB curve 765, hook weight curve 766, stand pipe pressure (SPP) curve 767, flow-in curve 768, ROP (in minutes/ft) curve 769, ROP (in ft/hr) curve 770 along a depth scale 771. Each of these curves 762-770 are again utilized together to identify vibration foundering limiters and increase the drilling rate.

In this example, the WOB was initially 25 klbs, which is a reasonable weight to apply to a 8½" PDC drill bit. The values of the MSE curve 762 are disproportionate at 500 ksi, which indicated inefficiency in rock of 10 ksi strength. If the formation is harder strength rock, such as the Hith anhydrite, Khail anhydrite and Khuff dolomites and anhydrites, whirl may be the founder limiter. To verify the founder limiter, the WOB was increased gradually to 35 klbs, while the values of the MSE curve 762 decreased to 200 ksi and the values of the ROP curve 770 increased from about 25 fph to 75 fph. Because the WOB is approaching the manufacturer's recommended limit, the WOB is not increased further and additional mitigation of the remaining whirl may involve a redesign of the drilling system. For instance, a motor with a 1.22 degree steering bend in it may be replaced with 0.78 to 1.0 degree settings to reduce rotational imbalance that creates some of the whirling tendency. In some intervals, the trajectory and target sizes may be modified to allow steerable motors to be replaced by high torque straight motors. These drilling component changes may increase the bit efficiency and increase the drilling rate.

Figure 7G:
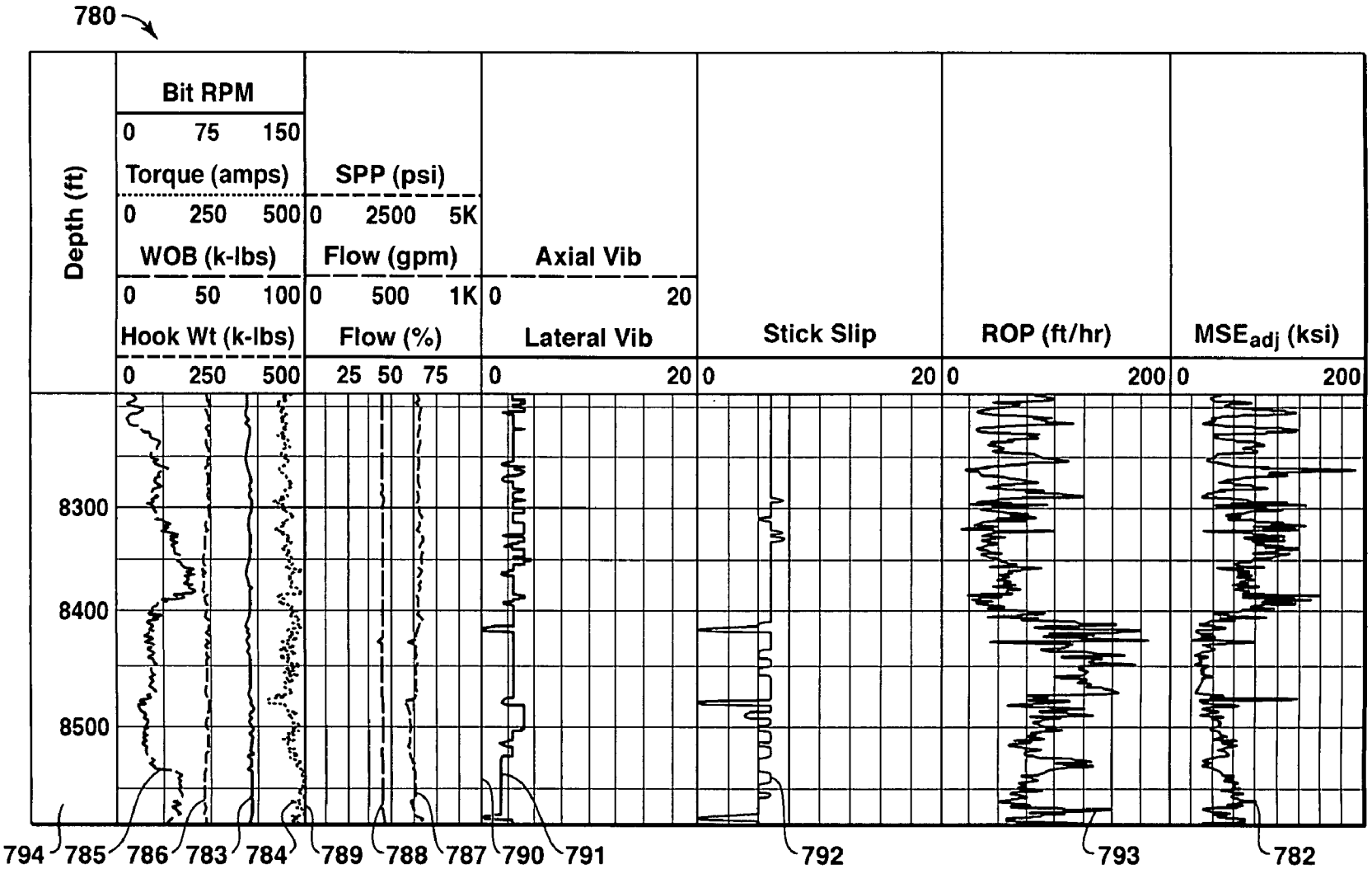

FIG. 7G shows a seventh example of using the MSE data along with other measured data to extend the vibration foundering limiters. In FIG. 7G, a chart, which is herein referenced by reference numeral 780, presents MSE and other measured data that are utilized to extend vibration founder limiters for the drilling system 102*a*. In particular, the MSE curve 782 is displayed along with other measured data, such as a drill bit RPM curve 783, torque curve 784, WOB curve 785, weight on hook (WOH) curve 786, SPP curve 787, flow-in curve 788, flow out curve 789, axial curve 790, lateral curve 791, stick slip curve 792 and/or ROP curve 793 along a depth scale 794. Each of these curves 782-793 are again utilized together to identify vibration foundering limiters and increase the drilling rate.

In this example, the change in drilling components extends the founder limiter and increases the drilling rate. In particular, a motor with a 0.78 degree steering bend was pulled and replaced by a straight motor for a 8½" wellbore. As shown in FIG. 7G, at around 8400 ft, the values of the MSE curve 782 decrease from about 80 ksi to 30 ksi, the values of the WOB curve 784 decrease from 40 klbs to 20 klbs, and the values of the ROP curve 793 increase from 50 fph to over 100 fph. As the founder limit is whirl, the replacement of the motor increases the ROP and beyond previous levels.

Figure 7H:
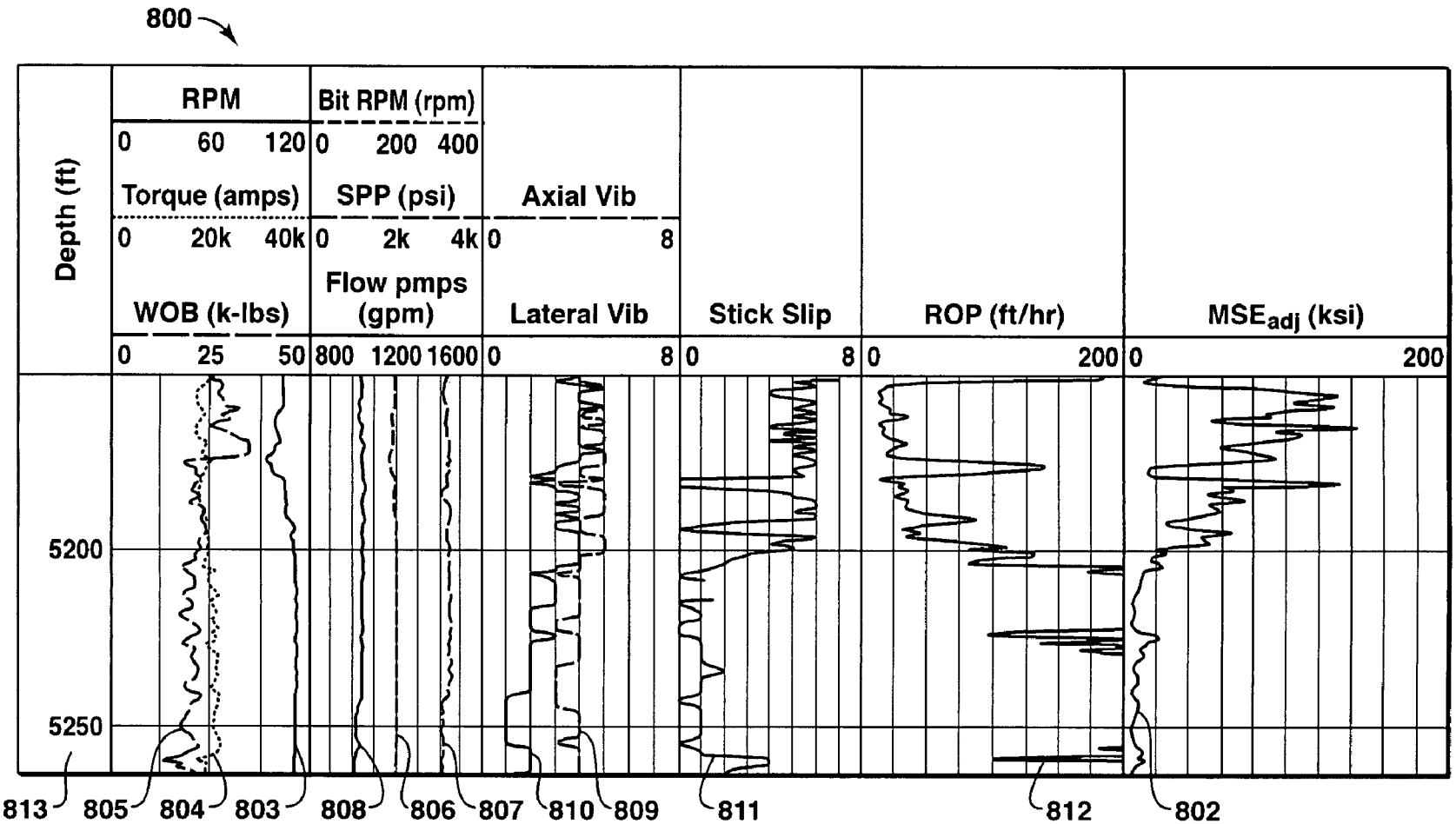

FIG. 7H shows an eighth example of using the MSE data along with other measured data to extend the vibration foundering limiters. In FIG. 7H, a chart, which is herein referenced by reference numeral 800, presents MSE and other measured data are utilized to extend vibration founder limiters for the drilling system 102*a*. In particular, the MSE curve 802 is displayed along with other measured data, such as a RPM curve 803, torque curve 804, WOB curve 805, drill bit RPM curve 806, SPP curve 807, flow pump curve 808, axial curve 809, lateral curve 810, stick slip curve 811 and/or ROP curve 812 along a depth scale 813. Each of these curves 802-812 are again utilized together to identify vibration foundering limiters and increase the drilling rate.

In this example, a drilling system 102*a* having a measuring device 406*a* for a 12¼" wellbore is utilized. The values on the MSE curve 802 indicate that vibrations, which are torsional vibrations or stick slip, are a founder limiter for this interval of the drilling system 102*a*. In particular, the initial values on the MSE curve 802 are above 100 ksi, while the measuring device, which is a downhole vibrations monitoring tool, indicates a high level of stick slip and a moderate level of whirl. Accordingly, at about 5185 ft, the WOB is decreases from about 45 klbs to 35 klbs, which results in a decrease in the values of the MSE curve 802 and the stick slip curve 811. Also, the values of the ROP curve 812 increase from 25 fph to over 200 fph. Thus, the vibration data and MSE data are utilized together to increase the ROP.

Figure 7I:
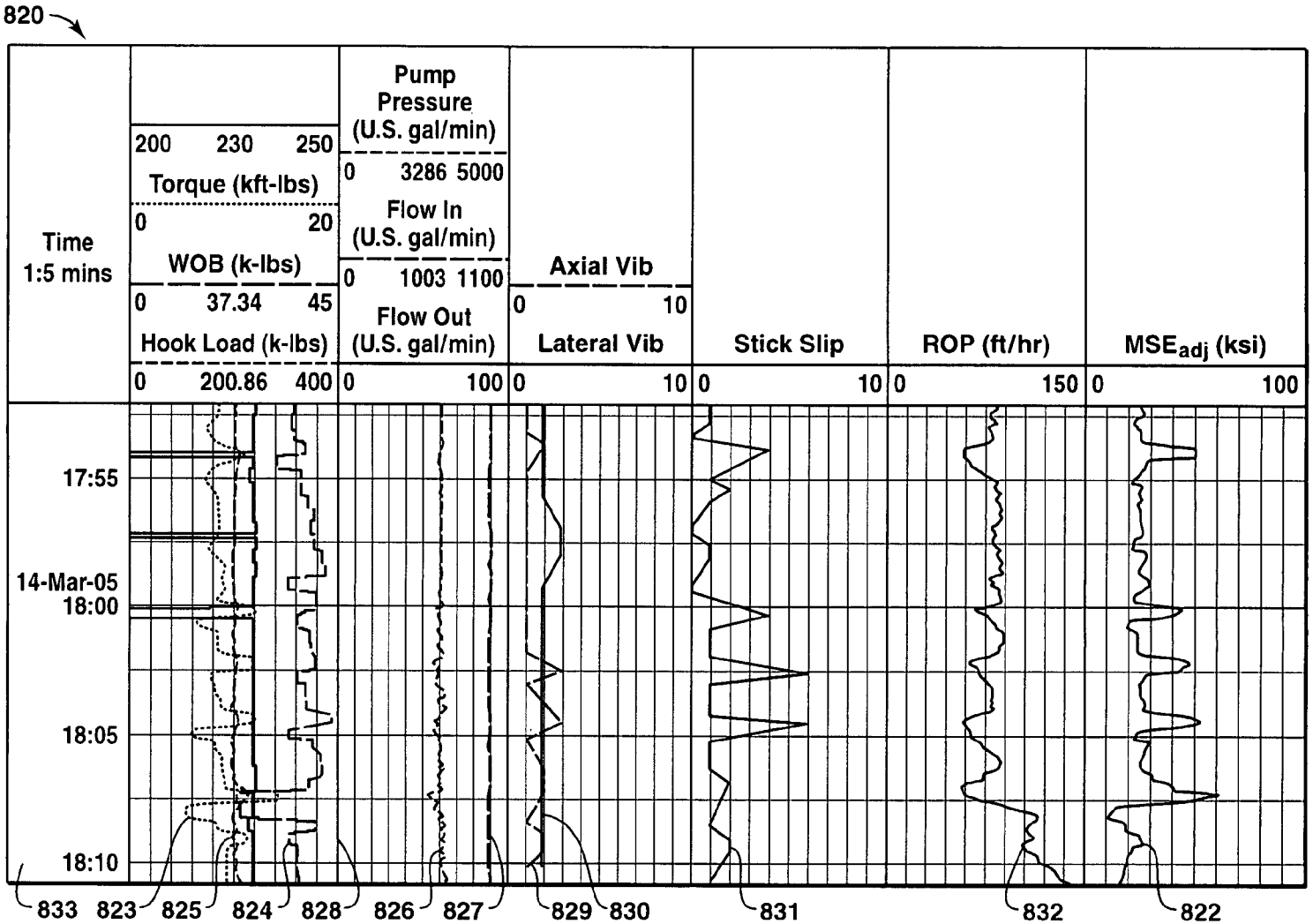

FIG. 7I shows a ninth example of using the MSE data along with other measured data to extend the vibration foundering limiters. In FIG. 7I, a chart, which is herein referenced by reference numeral 820, presents MSE and other measured data that are utilized to extend vibration founder limiters for the drilling system 102*a*. In particular, the MSE curve 822 is displayed along with other measured data, such as a torque curve 823, WOB curve 824, hook weight curve 825, pump pressure curve 826, flow in curve 827, flow out curve 828, axial curve 829, lateral curve 830, stick slip curve 831 and/or ROP curve 832 along a time line 833. Each of these curves 822-832 are again utilized together to identify vibration foundering limiters and increase the drilling rate.

In this example, a drilling system 102*a* includes data from a measuring device 406*a* in a well. As shown by the values of the MSE curve 822 and stick slip curve 831, changes in the values on the WOB curve 824 decrease the ROP. This indicates that the founder limiter is stick slip and a moderate amount of whirl, which occur during the increase in the WOB. While stick slip may be mitigated by increasing rotary speed, a combination of drill bit speed and WOB may be balanced to determine that does not develop whirl or stick slip.

Further, while it was possible to maximize the ROP for these founder limiters by adjusting the drilling parameters, a number of drilling component changes may be utilized to further increase the ROP. For instance, other drilling component changes may include extending bit gauge lengths to improve lateral stability, utilizing near bit stabilizers that rotating with the bit on straight assemblies rather than sleeve stabilizers, and utilizing high torque motors so that the system is not limited by motor differential when the whirl is effectively mitigated. Further, other drilling component changes may include tapering bit gauge areas, spiraling bit gauge areas, utilizing shock subs, changing location of drill string components, changing fluid rheology or including additive in the fluid to modify vibration behavior or changing the mass or stiffness of the drill string components. One measure of the success of whirl and stick slip mitigation efforts are the improved drill bit grades despite the high WOB being applied.

Figure 7J:
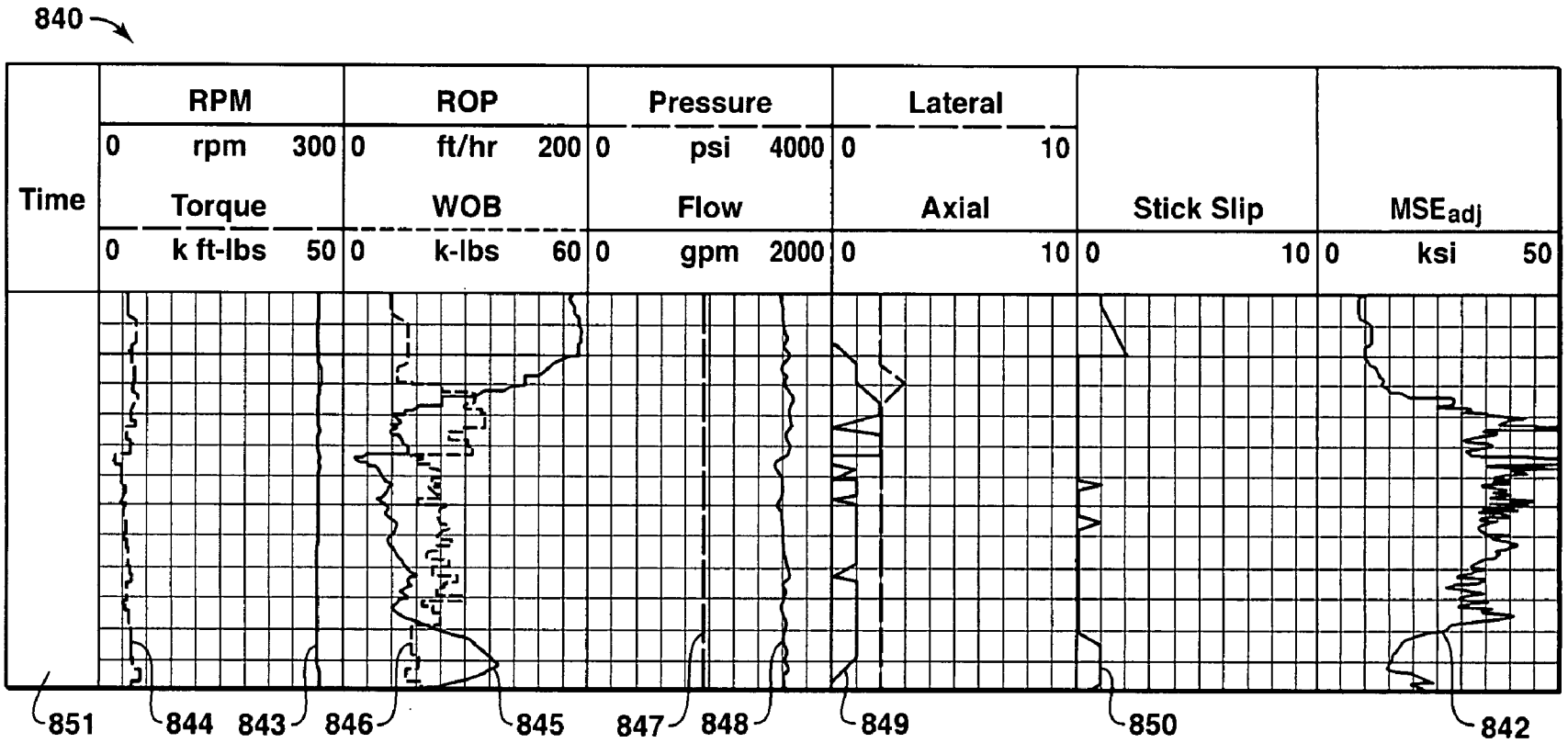

FIG. 7J shows a tenth example of using the MSE data along with other measured data to extend the vibration foundering limiters. In FIG. 7J, a chart, which is herein referenced by reference numeral 840, presents MSE and other measured data that are utilized to extend vibration founder limiters for the drilling system 102*a*. In particular, the MSE curve 842 is displayed along with other measured data, such as a RPM curve 843, torque curve 844, ROP curve 845, WOB curve 846, pressure curve 847, flow curve 848, axial curve 849, lateral curve 850 and/or stick slip curve 851 along a time line 852. Each of these curves 842-851 are again utilized together to identify vibration foundering limiters and increase the drilling rate.

In this example, a drilling system 102*a* having a measuring device 406*a* is utilized within a wellbore. Initially, the values of the MSE curve 842 are about 10 ksi. As axial vibrations occur, as shown in axial curve 849, the drilling operations encounter a hard interval of formation, such as a dolomite stringer. The WOB was increases from 10 klbs to 25 klbs and the values on the MSE curve 842 increase to about 35 ksi, which may be close to the rock strength in the dolomite stringer. When WOB was decreased to about 15 klbs to 20 klbs, axial vibration on the axial curve 849 decreased and the ROP increased accordingly.

Figure 7K:
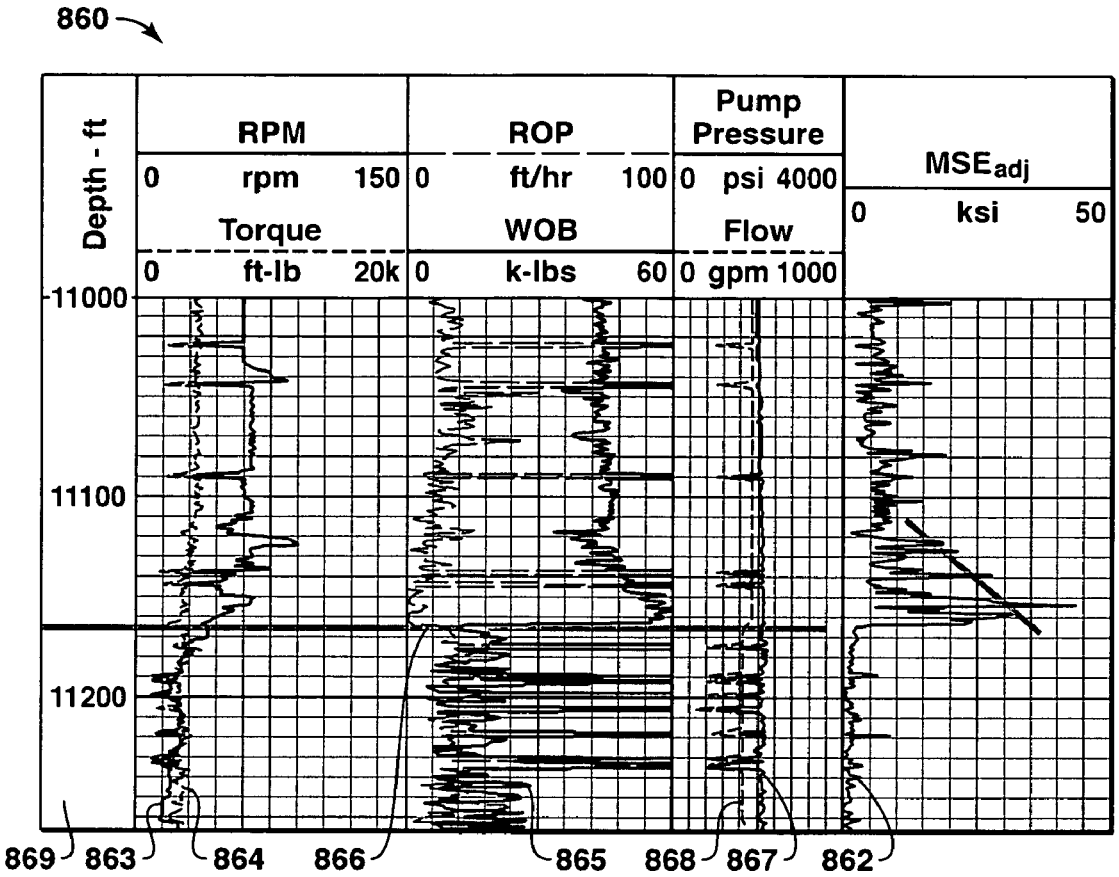

FIG. 7K shows an example of using the MSE data along with other measured data to determine bit dulling. In FIG. 7K, a chart, which is herein referenced by reference numeral 860, presents MSE and other measured data utilized to determine founder limiters for the drilling system 102*a*. In particular, the MSE curve 862 is displayed along with other measured data, such as the RPM curve 863, torque curve 864, ROP curve 865, WOB curve 866, pump pressure curve 867, and/or flow-in curve 868 along a depth scale 869. Each of these curves 862-868 are again utilized together to identify bit dulling and increase the drilling rate.

FIG. 7K includes other aspects of the present techniques that may utilize the MSE curve 862 to analysis and identify bit dulling trends. In this example, a drill bit 110*a* is an 8½" insert drill bit, which is utilized in a formation having rock strength of 20 ksi. In this particular example, high drill string torque for a directional well 104*a* and vibrations were detected. Because energy consumption tends to increase steadily over the last 50 ft to 100 ft for a dull drill bit, a drill bit tends to be efficient through the majority of its operation. However, once dulling begins the cutting profile changes rapidly and the bit becomes inefficient within a shorter period of time. Accordingly, as shown in the MSE curve 862 from around 11100 ft to 11170 ft, the values of the MSE curve 862 increase, while the values of the ROP curve 865 decrease. Once the drill bit is replaced, the MSE curve 862 and ROP curve 865 stabilize from beyond 11170 ft. Accordingly, the operator's knowledge of the expected drill bit life along with the MSE and other measured data may be utilized to enhance drilling rates by circumventing founder limiters.

It should be noted that MSE and other measured data surveillance is applicable to a variety of wells. For instance, the wells may include vertical and direction wells. Further, MSE and other measured data surveillance may be utilized for different rock types, different depths, and with drill bits for different sized wellbores.

As another embodiment, the drilling system devices 404*a*-404*n* may be coupled to other components in the drilling system 102*a*-102*n* to automate the drilling process. For example, many parameters are controlled by the feed rate of the drill string. The rate at which the string is advanced can be used to maintain desired values of WOB, torque, ROP and downhole motor differential. Accordingly, an operator of the drilling system 102*a*-102*n* may utilize the MSE data and other measured data to automate the control of the drilling operations. The drilling system devices 404*a*-404*n* may perform various tests, such as the MSE weight test and MSE data test, by automatically adjusting the drilling parameters, such as WOB and bit RPM. A computer controlled system might integrate the area continuously, and use the ongoing changes in area as an indication of the need to make changes in WOB or RPM.

As another embodiment, the drilling system devices 404*a*-404*n* may be coupled to other components in the drilling system 102*a*-102*n* to automate the drilling process. For example, many parameters are controlled by the feed rate of the drill string. The rate at which the string is advanced can be used to maintain desired values of WOB, torque, ROP and downhole motor differential. Accordingly, an operator of the drilling system 102*a*-102*n* may utilize the MSE data and other measured data to automate the control of the drilling operations. The drilling system devices 404*a*-404*n* may perform various tests, such as the MSE weight test and MSE data test, by automatically adjusting the drilling parameters, such as WOB and bit RPM. A computer controlled system might integrate the area continuously, and use the ongoing changes in area as an indication of the need to make changes in WOB or RPM.

Also, in another embodiment, the process of FIG. 3 may include some additional modification to the steps of FIG. 3 to utilize the process for two or more wells. For instance, in block 304, historical MSE data and other measured data may be analyzed from one or more previous wells to determine one or more of a plurality of factors that limit the drilling rate of the previous wells. Then, in block 306, drilling components or equipment and drilling practices may be selected to mitigate the factors. These drilling components and drilling practices may be utilized to begin the drilling of a current or planned well utilizing the mitigating techniques, as shown in block 308. While drilling, the MSE data and other measured data may be observed to further modify controllable drilling parameters, as shown in block 310. In block 312, the founder limiters or factors that limit the drilling rate of the current well may be recorded and documented as results in a manner that identifies the factors that continue to limit the drilling rate. Then, based on the observations, planning mitigations for one of a plurality of factors may be specified. This factor may be mitigated or addressed by changing drilling components or drilling practices in this or a subsequent well. This process may be repeated for other subsequent wells in the field, which may be part of a program.

Further, in other embodiments, the MSE data may be presented as 3 dimensional (3D) mappings of the MSE data along with other measured data. For instance, the MSE data may be mapped with different rotary speeds and different WOBs. In this example, the peaks in the map represent combinations of the two parameters that provide drill bit inefficiency. As such, an operator of the drilling system may use this data in real-time by using the WOB and RPM where the MSE was at a low point to optimize efficiency. While the example is for RPM and WOB, a variety of parameters can be mapped in this fashion while using MSE in the z-axis to visually show their effect on performance.

However, it should be noted that 3D mapping of MSE data and other measured data may be used to map virtually any drilling parameters and measured data that may be utilized to enhance efficiency. As noted above, the founder limiters are generally the basis for inefficiencies in the drilling operations. As a specific example, hydraulics and WOB are known to effect bit balling. Accordingly, a 3D mapping may be provided by pumping at a given flow rate, then raising the WOB in gradual steps to observe the changes in the MSE data. Then, the flow rate may be increased and the WOB raised in gradual steps to again observe the MSE data. With this data, a 3D mapping may be provided to an operator of a drilling systems to select the flow rate and WOB that provides the optimized ROP, while maintaining a low MSE.

The benefit of the 3D mapping comes from the fact that there are many settings and measured factors that may influence ROP simultaneously. The 3D mapping provides a mechanism for at least two of these to be analyzed at one time. Because many of these relationships are complex and difficult to predict, particularly those related to vibrations, mapping the settings and factors against MSE data provides an effective mechanism for determining founder limiters. Accordingly, the mapping concept includes, but is not limited to, the example parameter comparisons, such as WOB vs. RPM, HSI vs. WOB, hydraulic impact vs. WOB, Flow Rate vs. WOB, HSI vs. RPM and/or differential motor pressure vs. RPM. Also, the mapping concept may also be applied to vibration limiters. That is, the stick slip, axial or lateral vibrations data may be compared with different drilling parameters and MSE data to provide a clear indication of the vibration limiters. In each example, the two parameters may be plotted on the x and y axes, and the MSE data is mapped to a third axis to provide visual images of the parameter's effect on the drilling system efficiency. This may provide the operator with other perspectives to further enhance the drilling rate.

In addition to 3D mapping, other similar displays may be used to show the change in MSE on the vertical axis, such as color coding, texture or shade, and grid density. These different displays may assist the operator in differentiating between the different parameters to identify potential founder limiters.

Further, it should also be noted that the MSE data and other measured data may be utilized in the drilling of wells in a variety of locations. For instance, the MSE data and other measured data for a first well may be associated with a first subsurface formation. The MSE data and other measured data associated with the first well may be utilized to assist in the analysis of a second well being drilled to a second subsurface formation. In fact, these subsurface formations may even be located in different fields. As such, it should be appreciated that the MSE data and other measured data from a first well may be utilized for a well being concurrently drilled or subsequently drilled in the same or another field. That is, wells that encounter similar patterns or trends in MSE and other measured data may be analyzed to provide insight in drilling operations and practices in other wells.

Moreover, the use of MSE and other measured data may extend beyond reaching a terminal depth. For instance, as noted above, the MSE and other measured data may be utilized while reaming the wellbore for logging, reaming casing to bottom prior to cementing. Also, the data may be utilized with workover operations that involve drilling out plugs in a well or other material. As such, it should be appreciated that the Fast Drill Process extends through cementing and completion operations, or any subsequent remedial operations for the life of the well or wells within a field.

In addition, as noted above, non-bit limiters may be present within the drilling operations. For instance, non-bit limiters may include the rate at which cutting can be removed from the hole or handled by surface equipment, the drill rate at which logging while drilling tools can acquire formation data, the need to constrain the weight on the bit to control the direction it drills in, the ability of the specific drilling fluid to effectively seal the surface of permeable formations that are exposed, torque rating of the motor that may be in use, torque rating of the top drive or rotary table, make-up torque limits of the drill string, ability of the wellbore to withstand the increased circulating pressure from the cutting load at high ROP, downhole motor bearing load limits to WOB, and inability to transmit torque from surface to the bit due to frictional drag, adequate training of personnel to either measure, analyze, recognize or correct ROP limiters, ineffective display of data to allow analysis or communication, resistance of personnel to change, and resistance of personnel to perceived increases in operational risk.

With the factors limiting drilling operations being identified, these process described above provides a prioritization for the factors to streamline the enhancements. As noted above, because the number of factors, such as bit and non-bit limiters, may be large, the engineering resources utilized to resolve specific limiters may vary. Accordingly, to effectively manage resource allocation, the process may include a method for prioritizing the limiters in field operations. This prioritization may be best understood in the following example, which references to FIG. 2.

As shown in FIG. 2, when performing drilling operations, the WOB may be increased. If the ROP response is linear, which may be determined through MSE surveillance, the bit is efficient. Accordingly, the drilling operations may continue increasing WOB until non-linear response is observed, or the ROP becomes non-bit limited. For a non-linear response, operational adjustments may be made to minimize MSE by operating below the founder limiter. For bit and non-bit limiters, the founder may be identified and documented for communication to other personnel, such as engineering. Then, the drilling system may be redesigned to extend the identified limiter and the process may be repeated. Because bit and non-bit limiters are treated the same, the drilling operations focus on the one limiter with redesign efforts and resources to further enhance operations. Accordingly, in this process, one limiter may be identified for redesign for a given well at a time.

Beneficially, the focus on a defined number of limiters, such as one, helps to focus resources on complex problems. For example, the ROP in one offshore operation may be limited by the rate at which cuttings can be ground and reinjected. The limiter is not equipment related, but the need to constrain fracture growth height to the designated injection interval. This example is typical for control drilling operations because these operations involve a margin of uncertainty and any increase in ROP may involve effective management or mitigation of the increase in risk. The ROP management process ensures increased risks are mitigated, and this tends to be particularly true in the redesign of non-bit limiters.

Moreover, as another enhancement to the Fast Drill Process, training or global communication may be utilized. For instance, training may be designed to ensure that each person understands the workflow, the respective role, and is capable of identifying and mitigating the limiters in real-time. Accordingly, training for rig personnel may include aspects controlled at the rig, while an engineer may be trained to understand design changes to the equipment in the system.

The global communication may include exchanging data for various wells in different geographic locations to share common problems with the drilling operations to develop a solution. That is, data in different types of material may include similar characteristics to suggest many wells are constrained by similar issues. The workflow implication is that if an advance is made in extending a limiter in one well, the same or similar solution may be applied to other wells to remove other limiters. For example, the dysfunction of "mild vibrations" may be largely due to the onset of whirl, as formations become harder with depth. Because, this occurs worldwide and with all bit types, field experience and mitigating practices developed for whirl in one location are likely to work globally.

The benefits of effectively sharing learnings in a global setting are particularly evident for non-bit limiters. In many environments, rig personnel may operate in a specific geographic region and believe their local operating conditions are unique. When a solution to a limiter is developed or determined, the data is captured and may be shared with other drilling operations to align global drilling operations. As a result, the information sharing process provides a solution developed once may be used effectively across the global drilling operations.

Furthermore, the use of MSE data along with other data further assists in the planning phases for other wells. In particular, historical MSE plots may be developed from offset digital data and analyzed to identify the intervals where the drilling operations are dysfunctional. Each operations engineer may analyze this MSE data along with other data, such as downhole vibrations plots, to determine the nature of the potential dysfunction and potential mitigations. The non-bit limiters may also be identified in intervals where the MSE data shows the bit to be efficient and control drilling is occurring.

As an example, the MSE and other digital data may be plotted and observed continuously on displays at various locations on the rig while the well is being drilled. The operations of the driller, directional driller, logging while drilling (LWD) engineer, mud logger, mud engineer and other personnel may be coordinated to maximize the ROP. If a factor limiting the drilling operations is detected, then the personnel may identify the cause from the MSE curve and/or other data to react appropriately to mitigate the specific dysfunction. The limiters are documented and discussed within the personnel via emails or conference calls. Experience has shown the ability of offsite engineering personnel to effectively analyze MSE curves, vibrations, or other digital data is limited. For example, if digital data shows the WOB decline and simultaneously MSE increase, the offsite engineer may not be able to determine if the MSE increased because the WOB was reduced (indicating whirl had been induced), or the WOB was reduced because the MSE increased (indicating the crew was attempting to mitigate stick slip). Consequently, rig site personnel have become responsible for continuously documenting the ROP limiters.

After rig site personnel have made operational adjustments to extend ROP limiters, the nature of the remaining limiters is communicated to engineering for redesign. To the extent possible, this occurs in real-time and design changes are made on bit trips or whenever appropriate. To facilitate this, the operator provides real-time digital data (i.e. MSE data, vibration data, or other data) to an engineer. This data is collected and provided to a global information management center, from where it is distributed to the engineering staff and management for use with other wells. Accordingly, the engineer captures the documentation in an organized manner to aid in the redesign of subsequent wells or operations.

This process differs from historical practice in many aspects. First, bit records have been replaced by historical MSE analysis. Second, performance is assessed continuously over every foot of the wellbore drilled, rather than from the average 24-hour ROP or total run shown on bit records. This is done to adjust the performance of the drilling operations in real-time. Third, ROP is advanced by identifying specific limiters and re-engineering the system, rather than seeking a better performing system from offset empirical experience. Fourth, the historical MSE curve allows the learnings to be captured in a way that is accurate and convincing to ensure appropriate redesign occurs. Finally, the identification of both the limiter and a proposed solution helps to institutionalize and sustain redesign over multiple wells and long periods of time.

While the present techniques of the invention may be susceptible to various modifications and alternative forms, the exemplary embodiments discussed above have been shown by way of example. However, it should again be understood that the invention is not intended to be limited to the particular embodiments disclosed herein. Indeed, the present techniques of the invention are to cover all modifications, equivalents, and alternatives falling within the spirit and scope of the invention as defined by the following appended claims.

What is claimed is:

1. A method of producing hydrocarbons comprising:

(a) identifying a field having hydrocarbons;

(b) drilling at least one well to a subsurface location in the field to provide fluid flow paths for hydrocarbons to a production facility, wherein drilling is performed by:

(i) estimating a drill rate for one of the at least one well;

(ii) determining an efficient drilling methodology;

(iii) obtaining mechanical specific energy (MSE) data and other measured data during the drilling of the one of the at least one well;

(iv) using the obtained MSE data and other measured data to determine one of a plurality of limiters that limit the drill rate;

(v) adjusting the drilling operations to mitigate the one of the plurality of limiters;

(vi) iteratively repeating steps (i)-(v) until the subsurface location has been reached by the drilling operation; and (c) producing hydrocarbons from the one of the at least one well.

2. The method of claim 1 wherein the other measured data is vibration data.

3. The method of claim 2 wherein the vibration data comprises one of axial vibration data, lateral vibration data, stick slip vibration data and any combination thereof.

4. The method of claim 2 comprising providing the MSE data and the vibration data to an operator of a drilling system associated with the drilling operations.

5. The method of claim 4 comprising displaying the MSE data and the vibration data via a chart to the operator, wherein the MSE data and vibration data are displayed in different colors in the chart.

6. The method of claim 4 comprising displaying the MSE data and the vibration data together in a three dimensional mapping to the operator.

7. The method of claim 1 wherein adjusting the drilling operations comprises replacing drilling components in a drilling system.

8. The method of claim 7 wherein the replacing drilling components comprises one of changing drill bit, changing hydraulics, extending bit gauge lengths to improve lateral stability, utilizing near bit stabilizers that rotate with a drill bit on straight assemblies rather than sleeve stabilizers, replacing motors, tapering bit gauge areas, spiraling bit gauge areas, utilizing shock subs, changing location of drill string components, changing fluid rheology or including additive in the fluid to modify vibration behavior or changing the mass or stiffness of the drill string components and any combination thereof.

9. The method of claim 1 comprising adjusting drilling parameters to observe changes in the MSE data that indicate the at least one of the plurality of limiters.

10. The method of claim 1 wherein the plurality of limiters comprises non-bit related limits to the drill rate.

11. The method of claim 1 wherein the plurality of limiters comprises one or more of directional target control, hole cleaning, logging while drilling (LWD) data acquisition rates, shaker capacity, organizational processed, cutting handling and solids handling equipment limitations.

12. The method of claim 1 wherein the plurality of limiters comprises one of a rate at which cuttings are removed from the wellbore, a rate at which cuttings are handled by surface equipment, the drill rate at which logging while drilling tools can acquire formation data, and ability of specific drilling fluid to effectively seal surfaces of permeable formations that are exposed.

13. A method of producing hydrocarbons comprising:

(a) drilling a plurality of wells to at least one subsurface location to provide fluid flow paths for hydrocarbons to a production facility, wherein drilling comprises:
  (i) estimating a drill rate for one of the plurality of wells;
  (ii) obtaining mechanical specific energy (MSE) data and other measured data during the drilling of the one of the plurality of wells;
  (iii) using the obtained MSE data and other measured data to determine one of a plurality of limiters that restrict the drill rate;
  (iv) adjusting drilling operations to mitigate the one of the plurality of founder limiters;
  (v) iteratively repeating steps (i)-(v) until the subsurface location has been reached by the drilling operations; and (b) producing hydrocarbons from the one of the plurality of wells.

14. The method of claim 13 wherein the other measured data is vibration data.

15. The method of claim 13 wherein the vibration data comprises one of axial vibration data, lateral vibration data, stick slip vibration data and any combination thereof.

16. The method of claim 13 wherein adjusting the drilling operations comprises replacing drilling components in a drilling system.

17. The method of claim 13 comprising providing the MSE data and the other measured data to an operator of a drilling system associated with the drilling operations.

18. The method of claim 17 comprising displaying the MSE data and the other measured data together via a chart to the operator, wherein the MSE data and other measured data are displayed in different colors in the chart.

19. The method of claim 17 comprising displaying the MSE data and the other measured data together in a three dimensional mapping to the operator.

20. The method of claim 13 wherein the plurality of limiters comprises non-bit related limits to the drill rate.

21. The method of claim 13 wherein the plurality of limiters comprises at least one of directional target control, hole cleaning, logging while drilling (LWD) data acquisition rates, shaker capacity, organizational processed, cutting handling and solids handling equipment limitations.

22. A method of producing hydrocarbons comprising:

(a) estimating a drill rate for drilling operations of a well to provide fluid flow paths for hydrocarbons from a subsurface location to a production facility;
(b) obtaining real time mechanical specific energy (MSE) data and other measured data during the drilling of the well;
(c) using the obtained MSE data and other measured data to determine one of a plurality of limiters that restrict the drill rate;
(d) adjusting drilling operations to mitigate the one of the plurality of limiters; and
(e) repeating steps (a)-(d) until the subsurface location has been reached by the drilling operations.

23. The method of claim 22 wherein using the obtained MSE data and other measured data to determine one of the plurality of limiters comprises displaying the MSE data and the other measured data to an operator of a drilling system associated with the drilling operations.

24. The method of claim 23 wherein displaying the MSE data and the other measured data to the operator is performed using a chart.

25. The method of claim 23 wherein displaying the MSE data and the other measured data to the operator is performed using three dimensional mapping.

26. A method for drilling a well related to producing hydrocarbons comprising:

monitoring mechanical specific energy (MSE) data along with vibration data for a well in real-time during drilling operations;

comparing the MSE data and the vibration data with previously generated MSE data and the vibration data for the well to determine at least one of a plurality of factors that limit a drilling rate; and adjusting the drilling operations based on the comparison to increase the drilling rate.

27. The method of claim 26 comprising producing hydrocarbons from a subsurface reservoir accessed by the drilling operations.

28. The method of claim 26 wherein the vibration data comprises one of axial vibration data, lateral vibration data, stick slip vibration data and any combination thereof.

29. The method of claim 26 wherein comparing the MSE data and the vibration data comprises adjusting drilling parameters.

30. The method of claim 29 wherein the drilling parameters comprise weight on bit settings, revolutions per minute settings, torque settings and any combination thereof.

31. The method of claim 26 wherein adjusting the drilling operations based on the comparison comprises replacing drilling components in a drilling system.

32. The method of claim 31 wherein the replacing drilling components comprises one of changing drill bit, changing hydraulics, extending bit gauge lengths to improve lateral stability, utilizing near bit stabilizers that rotate with a drill bit on straight assemblies rather than sleeve stabilizers, replacing motors, and any combination thereof.

33. The method of claim 26 comprising adjusting drilling parameters to observe changes in the MSE data that indicate the at least one of a plurality of factors.

34. The method of claim 26 comprising providing the MSE data and the vibration data to an operator of a drilling system associated with the drilling operations.

35. The method of claim 34 comprising displaying the MSE data and the vibration data together in a chart to the operator.

36. The method of claim 34 comprising displaying the MSE data and the vibration data together in a three dimensional mapping to the operator.

37. A method for producing hydrocarbons comprising:

(a) obtaining mechanical specific energy (MSE) data along with other measured data for a well concurrently with the drilling of the well;

(b) analyzing the MSE data and the other measured data to determine one of a plurality of limiters that restrict a drilling rate; and (c) adjusting drilling operations to account for the one of a plurality of limiters based on the analysis in step (b) and to increase the drilling rate;

(d) repeating steps (a) to (c) at least one additional time until the target depth has been reached for the well; and (e) producing hydrocarbons from a subsurface reservoir accessed by the drilling operations.

38. The method of claim 37 wherein the other measured data comprises vibration data.

39. The method of claim 38 wherein the vibration data comprises one of axial vibration data, lateral vibration data, stick slip vibration data and any combination thereof.

40. The method of claim 37 wherein repeating steps (a) to (c) at least one additional time comprise repeating steps (a) to (c) three or more times.

41. The method of claim 37 wherein adjusting the drilling operations comprises adjusting drilling practices.

42. The method of claim 37 wherein adjusting the drilling operations comprises replacing drilling components in the drilling system.

43. The method of claim 42 wherein the replacing drilling components comprises one of changing a drill bit, changing hydraulics, extending bit gauge lengths to improve lateral stability, utilizing near bit stabilizers that rotate with a drill bit on straight assemblies rather than sleeve stabilizers, replacing motors, and any combination thereof.

44. The method of claim 37 comprising adjusting drilling parameters to observe changes in the MSE data that indicate the at least one of a plurality of limiters.

45. The method of claim 44 wherein the drilling parameters comprises weight on bit settings, revolutions per minute settings, torque settings and any combination thereof.

46. The method of claim 37 comprising providing the MSE data and the other measured data to an operator of a drilling system associated with the drilling operations.

47. The method of claim 37 comprising displaying the MSE data and the other measured data together in a chart to the operator.

48. The method of claim 47 comprising displaying the MSE data and the other measured data together in a three dimensional mapping to the operator.

49. The method of claim 37 wherein the plurality of limiters comprises non-bit related limits to the drill rate.

50. The method of claim 37 wherein the plurality of limiters comprises at least one of directional target control, hole cleaning, logging while drilling (LWD) data acquisition rates, shaker capacity, organizational processed, cutting handling and solids handling equipment limitations.

51. The method of claim 37 wherein the plurality of limiters comprises one or more of a rate at which cutting are removed from the wellbore, a rate at which cuttings are handled by surface equipment, the drill rate at which logging while drilling tools can acquire formation data, and ability of specific drilling fluid to effectively seal surfaces of permeable formations that are exposed.

52. A method for drilling a well related to producing hydrocarbons comprising:

drilling a first well concurrently with a second well;

monitoring mechanical specific energy (MSE) data along with vibration data in real-time during drilling operations in the first well;

comparing the MSE data and the vibration data from the first well to determine at least one of a plurality of factors that limit a drilling rate of the first well; and adjusting the drilling operations in the second well based on the comparison to increase the drilling rate.

53. The method of claim 52 comprising producing hydrocarbons from a subsurface reservoir accessed by the drilling operations in the first well.

54. The method of claim 52 wherein the first well is drilled to a first subsurface formation, and the second well is drilled to a second subsurface formation.

55. The method of claim 52 wherein the first subsurface formation and the second subsurface formation are located in different fields.

56. A method for drilling a well related to producing hydrocarbons comprising:

analyzing historical mechanical specific energy (MSE) data and other historical measured data from a previous well to determine one of a plurality of initial factors that limit a drilling rate for the previous well;

selecting drilling components and drilling practices to mitigate at least one of the plurality of initial factors;

drilling a current well utilizing the drilling components and drilling practices;

observing real time MSE data and other measured data during the drilling of the current well for at least one of a plurality of current factors that limit drilling operations;

utilizing the observations in the selection of subsequent drilling components and subsequent drilling practices to mitigate at least one of the plurality of current factors for a subsequent well; and repeating the steps above for each subsequent well in a program of similar wells.

57. The method of claim 56 further comprising modifying drilling parameters during the drilling of the current well to identify the at least one of the plurality of the current factors.

58. The method of claim 56 further comprising documenting MSE data and other measured data in a manner to identify the at least one of the plurality of the current factors that continue to limit the drilling rate.

* * * * *